US007104832B2

(12) United States Patent
Campbell et al.

(10) Patent No.: US 7,104,832 B2
(45) **Date of Patent: *Sep. 12, 2006**

(54) MODULAR ELECTRICAL CONNECTOR AND METHOD OF USING

(75) Inventors: James M. Campbell, Austin, TX (US); Mark A. Hoisington, Austin, TX (US); Brian C. Inberg, Cedar Park, TX (US); Mark D. Matthies, Austin, TX (US); Charles Mitchell, Austin, TX (US); Walter R. Romanko, Austin, TX (US); Richard D. Twigg, Leander, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/911,858

(22) Filed: Aug. 5, 2004

(65) Prior Publication Data

US 2006/0030201 A1 Feb. 9, 2006

(51) Int. Cl.
*H01R 11/20* (2006.01)

(52) U.S. Cl. ..... 439/411; 439/810

(58) Field of Classification Search ..... 439/411, 439/412, 416, 810, 811, 212, 290, 292, 715, 439/717, 928, 798, 812
See application file for complete search history.

(56) References Cited

U.S. PATENT DOCUMENTS

| | | | | |
|---|---|---|---|---|
| 2,164,381 A | | 7/1939 | Bradley | |
| 2,366,747 A | | 1/1945 | Moody | |
| 2,805,399 A | | 9/1957 | Leeper | |
| 2,851,670 A | | 9/1958 | Senior | |
| 3,350,677 A | | 10/1967 | Daum | |
| 3,372,361 A | | 3/1968 | Wengen | |
| 3,380,014 A | | 4/1968 | Schenker et al. | |
| 3,585,571 A | | 6/1971 | Davis | |
| 3,675,189 A | | 7/1972 | Smith | |
| 3,688,247 A | * | 8/1972 | Prodel | 439/416 |
| 3,725,840 A | | 4/1973 | Hesse | |
| 3,848,956 A | | 11/1974 | Kraft | |
| 3,851,946 A | | 12/1974 | Piaget et al. | |
| 4,050,761 A | | 9/1977 | De France | |
| 4,247,159 A | | 1/1981 | Fruchard | |
| 4,293,176 A | | 10/1981 | Lindlof | |
| 4,427,253 A | | 1/1984 | Smith et al. | |
| 4,550,965 A | | 11/1985 | Izraeli | |
| 4,640,571 A | * | 2/1987 | Walter et al. | 439/791 |
| 4,643,512 A | | 2/1987 | Prodel | |

(Continued)

FOREIGN PATENT DOCUMENTS

DE 195 13 645 A1 10/1996

(Continued)

OTHER PUBLICATIONS

U.S. Application entitled "Modular Electrical Connector and Method of Using", having a U.S. Appl. No. 10/911,802.

*Primary Examiner*—Tho D. Ta
*Assistant Examiner*—Vanessa Girardi

(57) ABSTRACT

An electrical connector includes a conductive body having a cavity therein. The cavity is configured to receive an end of a cable. A clamping member is provided for making electrical connection with the end of the cable. A first electrical bus portion is on a first side of the body, and a second electrical bus portion is on a second side of the body.

52 Claims, 21 Drawing Sheets

U.S. PATENT DOCUMENTS

| | | | | |
|---|---|---|---|---|
| 4,684,196 | A | | 8/1987 | Smith et al. |
| 5,015,198 | A | | 5/1991 | Delin |
| 5,041,012 | A | | 8/1991 | Caprio |
| 5,092,797 | A | | 3/1992 | Cole et al. |
| 5,423,692 | A | | 6/1995 | Francis |
| 5,727,314 | A | * | 3/1998 | Ashcraft ..... 29/884 |
| 5,885,109 | A | | 3/1999 | Lee et al. |
| 6,106,323 | A | | 8/2000 | Elisei et al. |
| 6,206,714 | B1 | | 3/2001 | Bernardini |
| 6,261,119 | B1 | | 7/2001 | Green |
| 6,264,492 | B1 | | 7/2001 | LaLaouna et al. |
| 6,402,544 | B1 | | 6/2002 | Barnett |

FOREIGN PATENT DOCUMENTS

| | | | |
|---|---|---|---|
| EP | 0 007 706 | A1 | 6/1980 |
| EP | 0 592 342 | A1 | 4/1994 |
| EP | 0 634 811 | A1 | 1/1995 |
| EP | 0 878 031 | B1 | 11/1998 |
| WO | WO 95/25229 | A | 9/1995 |
| WO | WO 97/28577 | | 8/1997 |
| WO | WO 0135495 | A | 5/2001 |

* cited by examiner

MODULAR ELECTRICAL CONNECTOR AND METHOD OF USING

CROSS-REFERENCE TO RELATED APPLICATIONS

Reference is made to related U.S. patent application Ser. No. 10/911,802 entitled "Modular Electrical Connector System and Method of Using", filed on the same date herewith, and having common inventorship and assignment.

FIELD OF THE INVENTION

The present invention relates to electrical connectors for connecting cable conductors. More particularly, the invention relates to a modular electrical connector that may be mated with similarly constructed modular electrical connectors to form an electrical connection between two or more cable conductors, and a method of using the modular electrical connector.

BACKGROUND

Electrical power cables are ubiquitous and used for distributing power across vast power grids or networks, moving electricity from power generation plants to the consumers of electric power. Power cables characteristically consist of a conductive core (typically copper or aluminum) and may be surrounded by one or more layers of insulating material. Some power cables include a plurality of conductive cores. Power cables may be constructed to carry high voltages (greater than about 50,000 Volts), medium voltages (between about 1,000 Volts and about 50,000 Volts), or low voltages (less than about 1,000 Volts).

As power cables are routed across the power grids to the consumers of electric power, it is often necessary or desirable to periodically form a splice or junction in the cable so that electricity may be distributed to additional branches of the grid. The branches may be further distributed until the grid reaches individual homes, businesses, offices, and so on. For example, a single power cable supplying electrical power to a group of several buildings must be branched to each of the buildings. As used herein, the terms "splice" and "junction" are used interchangeably, and in each case refer to the portion of a power distribution system where an incoming cable is connected to at least one outgoing cable.

At each point where the cable is connected, it is necessary to provide some type of branch connector or splice or termination on the cable. Up to the present time, branches in cables have commonly been made using pre-formed branch connectors having a predetermined type and fixed number of branches.

The current products for splicing power cables to form branches have disadvantages. For example, the splice products (sometimes referred to herein as "branch connectors") must be purchased having a predetermined and fixed number of connection ports. This requires the end user to accurately anticipate the future connection requirements at each splice location, and then purchase a branch connector to meet the anticipated future needs. In other words, if the anticipated future need is to have four electricity services, a five-port splice must be initially installed to allow for the incoming supply cable and the four outgoing service cables. In addition, to provide a "safety margin" to accommodate possible future expansion, the end user will generally install a splice having an additional connection port beyond the current anticipated needs. Therefore, a six-port splice is installed on the incoming supply cable, when the anticipated need is for only four outgoing service cables to be installed in the future. This over-building leads to wasted capital expenditures, in the form of unused ports installed in the power distribution system. Further, if future expansion of the power distribution system eventually exceeds the original anticipated needs and any extra ports that may have been originally installed, then an entirely new splice with additional connection ports must be installed. The installation of a new splice requires the disconnection and disruption of service of all existing service cables extending from the original splice, and then reconnection to a new larger splice product. Of course, the new splice product will typically have unused ports and the associated wasted capital, just like the original splice product.

An additional problem with the current splice product configurations is the large number of products that must be manufactured and inventoried to provide for all of the possible splice requirements in terms of the number of connections required. For example, a typical splice product family might contain five different configurations, with each configuration having a different number of connection ports (i.e., two ports, three ports, four ports, five ports, six ports). Some product families need as many as ten different number of port configurations. The large number of product variations, just in terms of the number of connection ports, leads to significantly higher manufacturing costs for the supplier and higher inventory costs for the end user.

Additionally, there is an increased number of splice product configurations due to the many different types of cable constructions, configuration, and sizes required for different power distribution applications. For example, a business may require a power service with a 1,000 MCM power cable, a house may require service with a 4/0 AWG power cable, and a streetlight may require service with a #12 AWG cable. These cables could be stranded or solid, aluminum or copper, with different insulation composition types and thickness.

The complexity of the splice product families, due to the number and type of port configurations, can also lead to reduced productivity for the end user. Specifically, the complexity of the splice product families leads to additional time spent by the installers determining the correct splice product configuration for the current installation (i.e., examining the installation site requirements and reviewing product offerings to find the product that best meets the requirements), and actually obtaining the correct product (i.e., trips to the truck and back, or trips to the warehouse and back if the correct product is not in stock on the truck, etc.).

New neighborhoods and buildings (and thus new cable branches) are constantly being added to the power grid, and existing networks are constantly being modified. Therefore, a need exists for a branching connector that allows for easy expansion of the power distribution system, and that is readily adaptable for different numbers of outgoing service cable branches from an incoming supply cable. Further, because many different types and sizes of cables are used in the power transmission industry, it is desirable to have a branching connector that is easily adaptable for connection to a large variety of cable types in order to reduce manufacturing, handling and inventory costs associated with building and maintaining a large inventory of diverse connectors. Further, it is desirable to have an expansion connection capability to improve installer productivity by simplifying the planning process and eliminating undesirable trips from the field to the warehouse. It is further desirable for the ability to add expansion ports without disrupting existing service connections. It is further desirable for such connectors to be able to interconnect cables in as cost-effective manner as possible.

SUMMARY

The invention described herein provides an electrical connector for use with a cable conductor. In one embodiment according to the invention, the electrical connector comprises a conductive body having a cavity therein. The cavity is configured to receive an end of a first cable, and a first clamping member is provided for making electrical connection with the end of the first cable. A first electrical bus portion is on a first side of the body, and a second electrical bus portion is on a second side of the body.

In another embodiment according to the invention, an electrical connector system comprises a first connector module configured for electrical connection to a first cable conductor, and a second connector module configured for electrical connection to a second cable conductor. Each of the first and second connector modules includes a first conductive engagement member on a first side of the module and a second conductive engagement member on a second side of the module. The first conductive engagement member of the first connector module is configured for engagement with the second conductive engagement member of the second connector module.

In another embodiment according to the invention, a modular electrical connector comprises a conductive body having a plurality of clamping members. Each of the plurality of clamping members is configured for making electrical connection with a corresponding cable conductor. A first electrical bus portion is on a first side of the conductive body, and a second electrical bus portion is on a second side of the conductive body.

In another embodiment according to the invention, a modular electrical connector comprises a conductive body having at least one clamping member configured to make electrical connection with a cable conductor. Connector means are provided on the body for electrically and mechanically connecting the body to another modular electrical connector having similar connector means.

In another embodiment according to the invention, a method for branching a cable conductor comprises electrically connecting a first cable conductor to a first connector module, and electrically connecting a second cable conductor to a second connector module. The first connector module includes a first electrical bus portion on a first side of the first module and a second electrical bus portion on a second side of the first module. The second connector module includes a first electrical bus portion on a first side of the second module and a second electrical bus portion on a second side of the second module. The first electrical bus portion of the first connector module is engaged with the second electrical bus portion of the second connector module.

BRIEF DESCRIPTION OF THE DRAWINGS

FIG. 1 is a front elevational view of the modular electrical connector;

FIG. 2 is a right front side perspective view of the modular electrical connector;

FIG. 3 is a left front side perspective view of the modular electrical connector; and FIG. 4 is a top plan view of the modular electrical connector.

FIG. 5 is a front elevational view of the modular electrical connector;

FIG. 6 is a right front side perspective view of the modular electrical connector;

FIG. 7 is a left front side perspective view of the modular electrical connector; and FIG. 8 is a top plan view of the modular electrical connector.

FIG. 9 is a front elevational view of the joined modular electrical connectors;

FIG. 10 is a top plan view of the joined modular electrical connectors; and

FIG. 11 is a back elevational view of the joined modular electrical connectors.

FIG. 12 is a front elevational view of the joined modular electrical connectors;

FIG. 13 is a top plan view of the joined modular electrical connectors; and

FIG. 14 is a back elevational view of the joined modular electrical connectors.

FIG. 17 is a right front side perspective view of the modular electrical connector;

FIG. 18 is a left front side perspective view of the modular electrical connector; and FIG. 19 is a right side elevational view of the modular electrical connector, showing hidden elements.

FIG. 20 is a right front side perspective view of the modular electrical connector; and FIG. 21 is a left front side perspective view of the modular electrical connector.

FIG. 22 is a right front side perspective view of the joined modular electrical connectors; and FIG. 23 is a left front side perspective view of the joined modular electrical connectors.

FIG. 24 is a right front side perspective view of the joined modular electrical connectors; and FIG. 25 is a left front side perspective view of the joined modular electrical connectors.

FIG. 26 is a front elevationai view of the modular electrical connector; and FIG. 27 is a left front side perspective view of two of the modular electrical connectors of FIG. 26 joined according to one embodiment of the invention.

FIG. 28 is a front elevational view of the modular electrical connector; and FIG. 29 is a left front side perspective view of three of the modular electrical connectors of FIG. 28 joined according to one embodiment of the invention.

FIG. 30 is a front elevational view of the modular electrical connector according to one embodiment of the invention; and FIG. 31 is a left front side perspective view of two of the modular electrical connectors of FIG. 30, joined according to one embodiment of the invention.

FIG. 32 is a right backside perspective view of the modular electrical connector, without an insulative housing;

FIG. 33 is a right back side perspective view of the modular electrical connector of FIG. 32, with an insulative housing; and FIG. 34 is a right backside perspective view of two of the modular electrical connectors of FIG. 33 joined according to one embodiment of the invention.

FIG. 35 is a back elevational view of two of the modular electrical connectors, without an insulative housing, as they begin to engage according to one embodiment of the invention;

FIG. 36 is an enlarged view of the joined electrical busses of the modular electrical connectors of FIG. 35, with an insulative housing on one of the modular electrical connectors; and FIG. 37 is a back elevational view of the modular electrical connectors of FIGS. 35–36 in a fully joined configuration.

DETAILED DESCRIPTION

Figure 2:
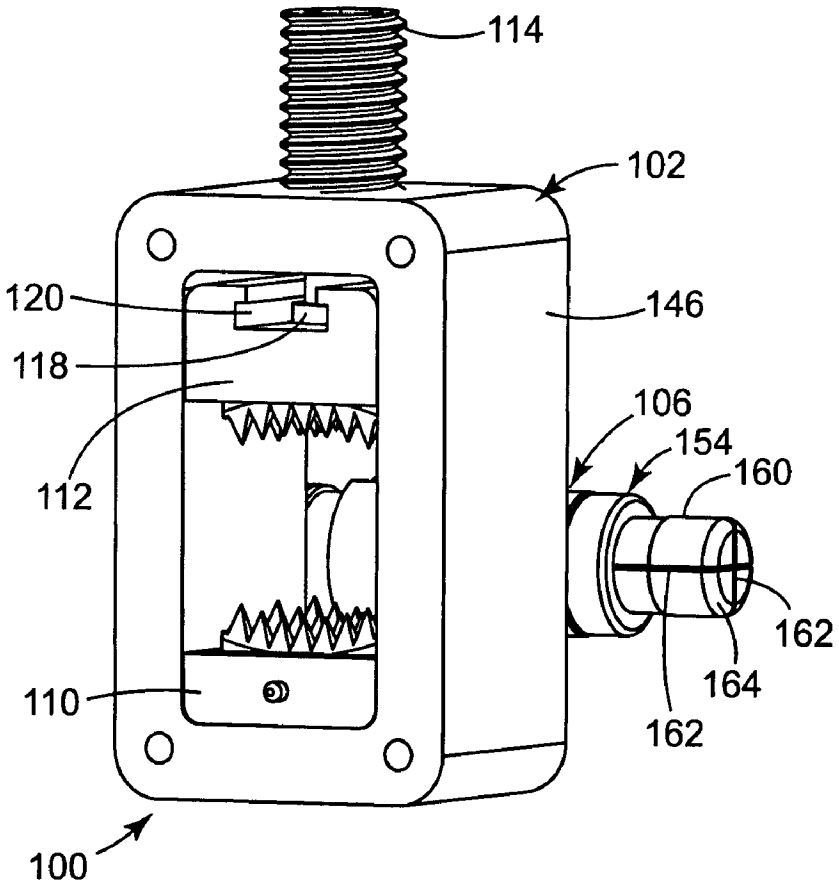
FIGS. 1–4 illustrate one embodiment of a modular electrical connector according to the invention, without an insulative housing, where.
Figure 1:
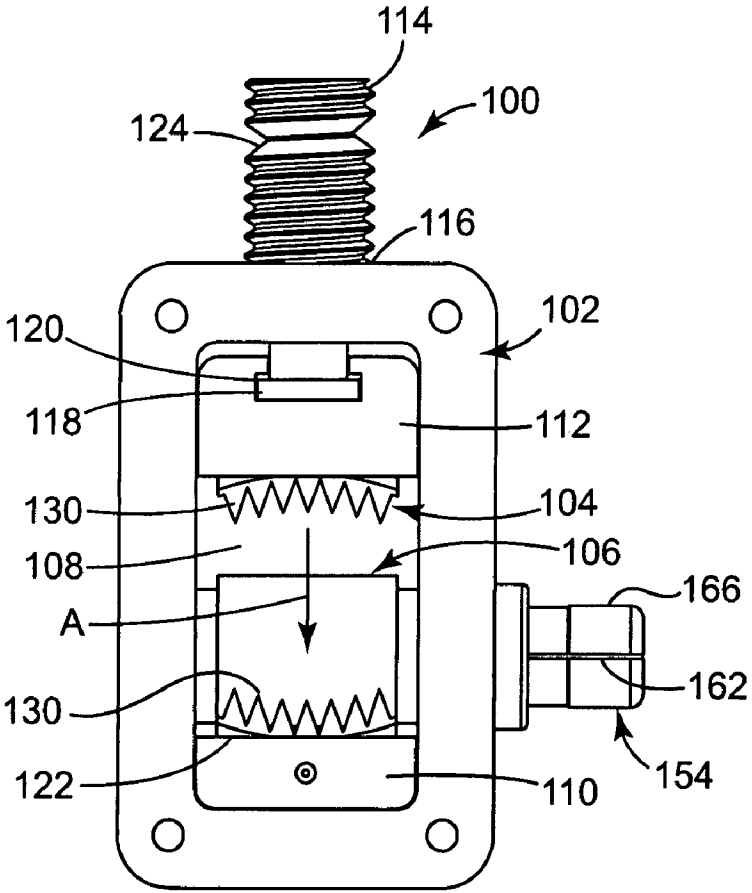
Figure 4:
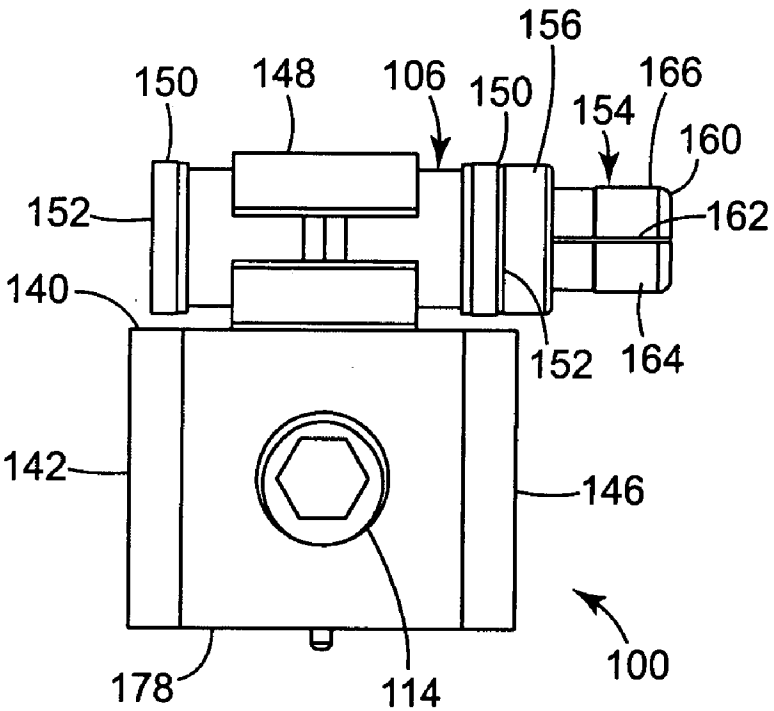
Figure 3:
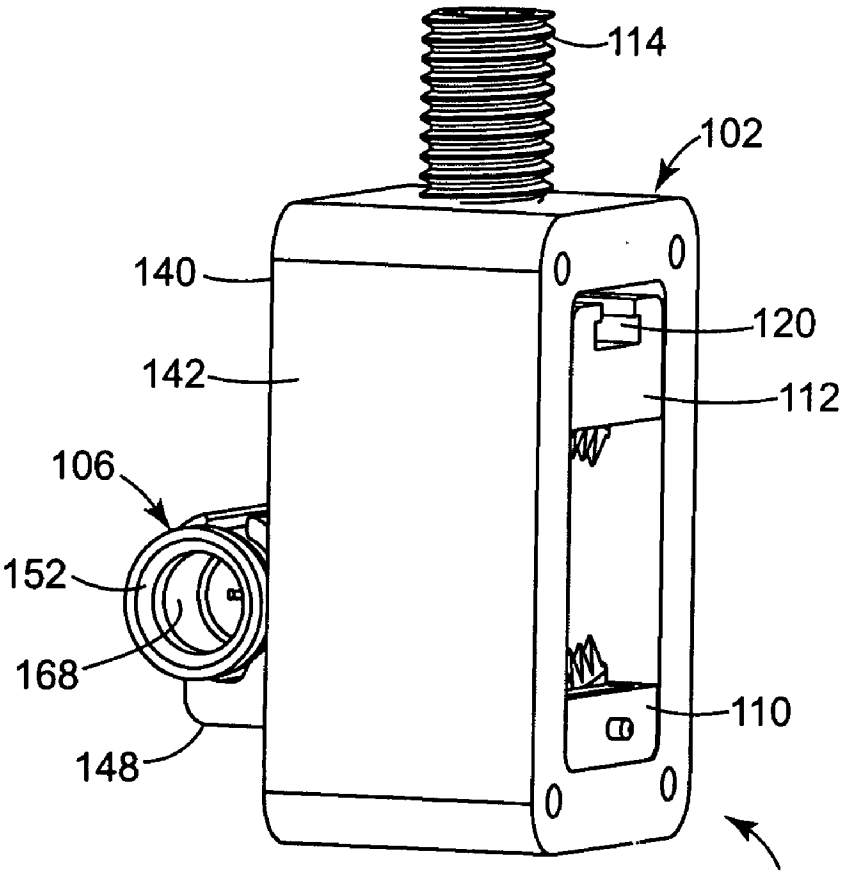
Figure 6:
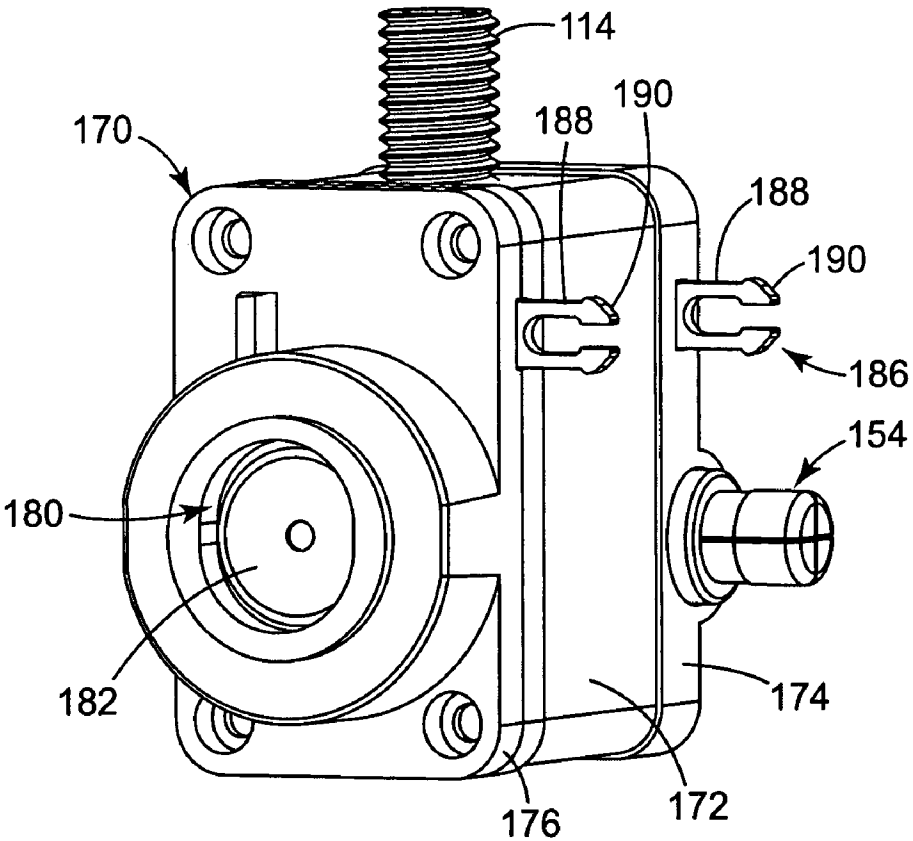
FIGS. 5–8 illustrate the modular electrical connector of FIGS. 1–4, with an insulative housing, where.
Figure 5:
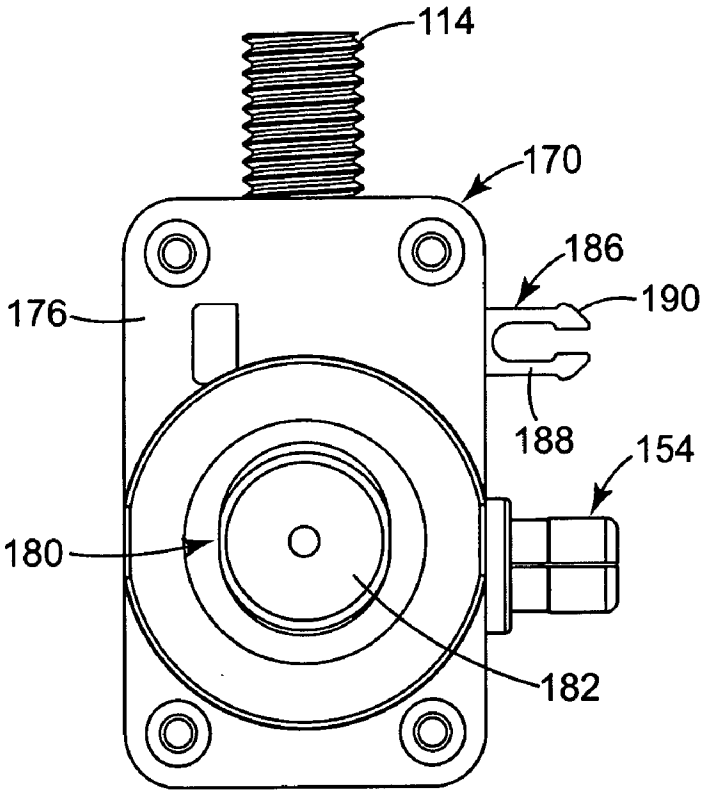
Figure 8:
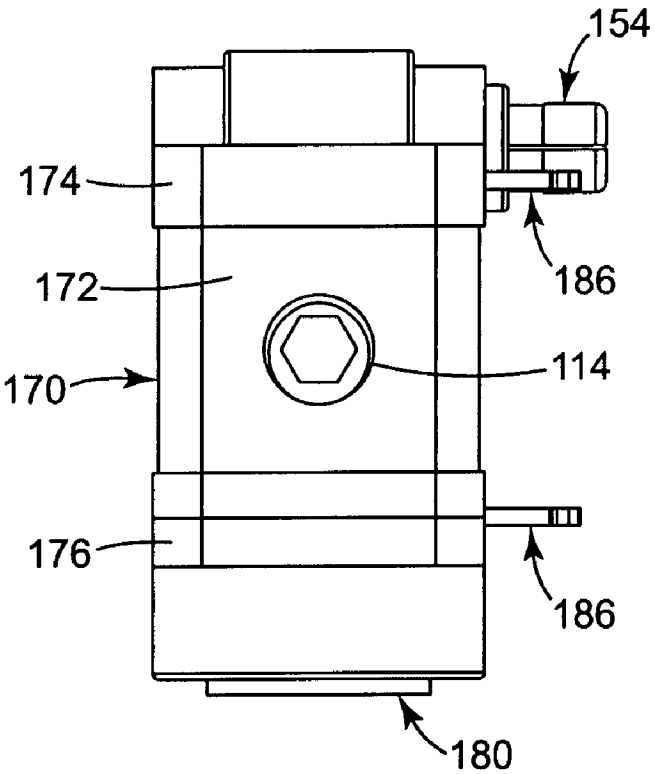
Figure 7:
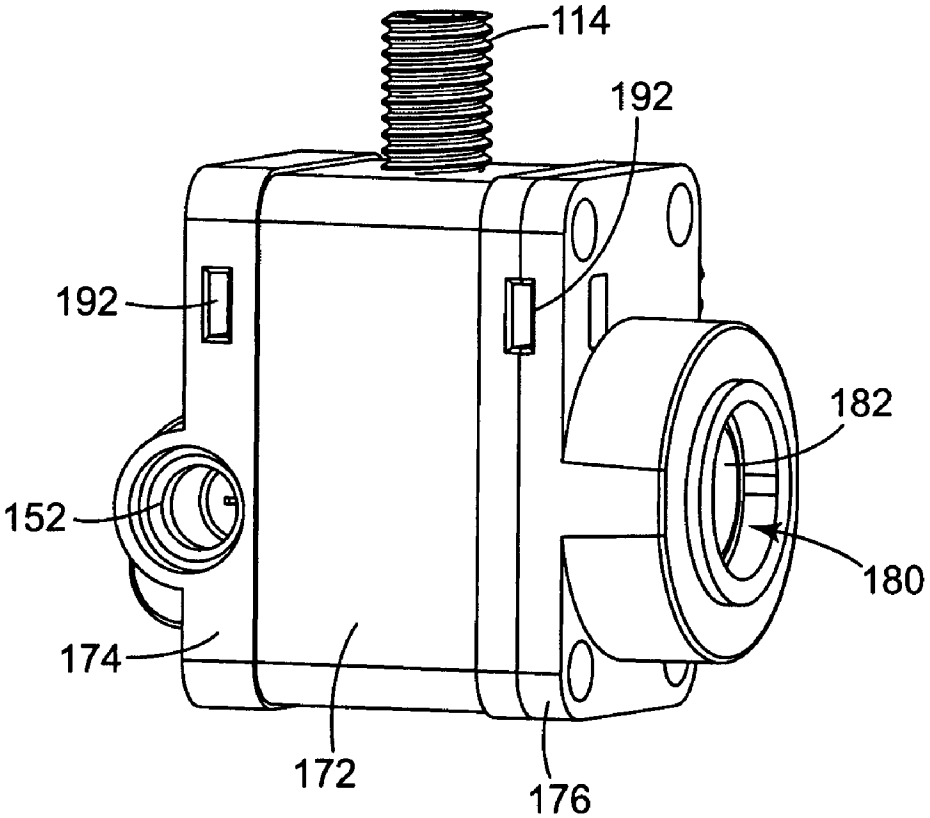

In the following detailed description of the preferred embodiments, reference is made to the accompanying drawings, which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

A plurality of exemplary embodiments of a modular electrical connector according to the present invention are illustrated and described herein. Each of the exemplary embodiments of a modular electrical connector generally comprise a conductive body for receiving a cable, a clamping member for securing the cable to the body and establishing an electrical connection with the cable, and an electrical bus for connecting two or more modular connectors together to form a branch. The conductive body, clamping member and electrical bus are formed of any suitable conductive materials, such as aluminum, brass, copper or other conductive materials, and are in electrical communication with each other. In some embodiments, the conductive body, clamping member and electrical bus are formed as separate components that are assembled to create a modular electrical connector. In other embodiments, the conductive body and electrical bus are formed as a monolithic structure. An insulative outer housing optionally encloses the conductive body, clamping member, and a portion of the electrical bus. Optionally, the outer housing includes moisture seals to prevent water ingress into any electrical connection points.

FIGS. 1–14 illustrate a first exemplary embodiment of a modular electrical connector 100 according to the invention. As best seen in FIGS. 1–4, the modular electrical connector 100 includes a conductive body 102, a clamping member 104, and an electrical bus 106. The conductive body 102 includes a cavity 108 extending longitudinally into the body 102. The cavity 108 is illustrated as extending completely through the body 102. However, in alternate embodiments, the cavity 108 need not extend completely through the body 102, so long as the cavity 108 is able to receive the clamping member 104 and a cable conductor end (not shown) therein.

The clamping member 104 is positioned within the cavity 108, and includes a fixed jaw portion 110 and a movable jaw portion 112. As illustrated, the jaw portions 110, 112 are separately manufactured from the body 102 and later assembled with the body 102. In another embodiment, the fixed jaw portion 110 may be integrally formed with the body 102. The movable jaw portion 112 moves transversely to a longitudinal axis of the cavity 108, and is actuated by a threaded bolt 114 extending through a threaded bore 116 in the body 102. The bolt 114 and movable jaw portion 112 are operably joined by slidably inserting an enlarged head 118 on the bolt 114 into a T-shaped slot 120 in the movable jaw portion 112. In this manner, the bolt 114 may rotate along its longitudinal axis relative to the movable jaw portion 112. As the bolt 114 is turned and advanced into the cavity, the movable jaw portion 112 of the clamping member 104 moves in the direction of arrow A and clamps a cable conductor (not shown) between the moveable jaw portion 112 and the fixed jaw portion 110 on the opposed inner surface 122 of the cavity 108. Likewise, when the bolt 114 is turned and retracted from the cavity 108, the movable jaw portion 112 loosens from the cable conductor. In one embodiment, the bolt 114 may have a torque limiting head 124 (illustrated in FIG. 1 only) that is either integral with the bolt 114 or a separate part fixed to the bolt 114. The torque limiting head 124 may then be shearable when excessive torque is applied. In this manner, the compressive force applied by the bolt 114 to clamp a conductive cable in the cavity 108 is precisely controlled and limited.

The fixed and movable jaw portions 110, 112 of the clamping member 104 may be of any suitable configuration for establishing electrical and mechanical connection with the cable conductor. In a preferred embodiment, the jaw portions 110, 112 of the clamping member 104 form an insulation piercing connector (IPC), in which teeth 130 are provided on one or both of the jaw portions 110, 112 to pierce an insulative covering of the cable conductor and make electrical contact with the conductive core of the cable as the clamping member 104 is tightened upon the cable conductor. In other embodiments, when the cable conductor is stripped of insulation and the bare conductor is inserted into the cavity, the teeth 130 may not be necessary to establish sufficient mechanical and electrical connection between the clamping member 104 and the cable conductor. Preferably, the cavity 108 and clamping member 104 are sized to receive and make electrical and mechanical connection to a range of sizes of electrical conductors. These sizes would include a typical range from #14 AWG (approximately 2.5 $mm^2$) to 1000 kcmil (approximately 500 $mm^2$) power cables. Preferably, the cable sizes range from #6 AWG (approximately 16 $mm^2$) to 500 kcmil (approximately 240 $mm^2$).

The teeth 130 of the jaw portions 110, 112 may be formed in any suitable manner, such as by molding, machining, extruding, or a combination thereof. The shape, size, composition, number, and orientation of the teeth 130 are influenced by the construction of the cable to be clamped by the jaw portions 110, 112. In some embodiments, the jaw portions 110, 112 may be provided with ridges, rather than individual teeth.

As best seen in FIGS. 1–4, the electrical bus 106 is positioned adjacent a back side 140 of the body 102, and extends from a first lateral side 142 of the body 102 across a back side 140 of the cavity to a second lateral side 146 of the body 102. The electrical bus 106 can also act as a cable stop, preventing over-insertion of a cable end into the cavity 108 and aiding in the proper positioning of the cable end. The electrical bus 106 is illustrated as a tubular member secured to and placed in electrical communication with the body 102 by a clamping portion 148 extending from the body 102.

The electrical bus 106 is configured to make electrical connection with the electrical bus 106 of a mating modular electrical connector 100 (described below in greater detail with reference to FIGS. 9–14). In the embodiment in FIGS. 1–8, each end 150 of the electrical bus 106 has a receptacle 152 for receiving a conductive bus pin 154 therein. As seen in the FIGS. 1–8, the conductive bus pin 154 is shown inserted into only one receptacle 152 of the electrical bus 106, while the other receptacle 152 remains empty. The bus pin 154 includes an enlarged circumferential ridge 156 along its midline for limiting the insertion of the bus pin 154 into the receptacles 152. The ends 160 of the bus pin 154 are provided with one or more slots 162 along the longitudinal axis of the bus pin 154, such that resiliently deflectable arm members 164 are provided at the ends 160 of the bus pin 154. In FIGS. 1–8, the bus pin 154 is illustrated as having two orthogonally aligned slots 162 forming four resiliently deflectable arm members 164 at each end 160 of the bus pin 154. The resiliently deflectable arm members 164 may be compressed together slightly as the bus pin 154 is inserted into the electrical bus receptacle 152, such that a compressive force is created between the resilient arm members 164 and the receptacle 152. In a preferred embodiment, the ends 160 of the bus pin 154 are provided with an enlarged circumferential ridge 166 and the receptacles 152 have a corresponding recess 168, such that when the bus pin 154 is fully inserted into the receptacle 152, the enlarged circumferential ridge 166 locks into the corresponding recess 168 of the receptacle 152. The shapes of the bus pin 154 and mating receptacle 152 may be selected such that the bus pin 154 and electrical bus 106 are inseparable after engagement, or alternately such that the bus pin 154 and electrical bus 106 may later be separated without damage to the connectors 100.

In selecting the shapes of the bus pin 154 and mating receptacles 152 of the electrical bus 106, the desire to obtain a low electrical contact resistance at the inter-module connection should be taken into consideration. The actual connection force required to produce the desired contact resistance is dependent on many variables, including but not limited to factors such as: the rated amperage of the cables being connected; the desired safety factor above this rated amperage to survive fault currents, lightning strikes, and other over-voltages; the resistivities of the contacting metals; the micro-hardnesses of the contacting metals; the absence or presence of plating over the base metal; the ability of the connection to thermally conduct away heat generated by the contact resistance; and the amount and types of impurities on the contacting surfaces, including oxides, sulfates, greases, and other contaminants.

In alternate embodiments, shapes of the electrical bus 106 and the bus pin 154 may be reversed. That is, the electrical bus 106 may be formed as a pin-like member having resiliently deflectable arm members at its ends, and the bus pin 154 may be formed with receptacles for receiving the deflectable arm members of the electrical bus 106. In yet another alternate embodiment, the electrical bus 106 may be formed such that one side of the bus forms a male connector element, while the opposite side of the bus forms a female connector element.

In the embodiment illustrated in FIGS. 1–4 (as well as in other embodiments describe herein), the conductive body 102 is shown as a one-piece element. However, the body 102 could alternately be assembled from a plurality of components (e.g., side walls, bottom wall and top wall). Likewise, as illustrated in FIGS. 1–4 the clamping member 104 and electrical bus 106 are illustrated as separately formed elements that are later assembled to the body 102. However, in alternate embodiments, all or portions of the clamping member 104 and electrical bus 106 may be integrally formed with the body 102. For example, the lower (fixed) jaw portion 110 of the clamping member 104 may be integrally formed with the body 102. Similarly, the electrical bus 106 may be integrally formed with the body 102, rather than being connected thereto by clamping portion 148.

The modular electrical connector 100 may be provided with an outer insulative housing 170 enclosing the conductive elements of the connector.

Referring now to FIGS. 5–8, the conductive body 102, clamping member 104 and electrical bus 106 of FIGS. 1–4 are shown enclosed in an insulative outer housing 170. The outer insulative housing 170 includes a body portion 172 that receives the conductive body 102 and surrounds the exterior of the conductive body 102. A back wall portion 174 of the insulative housing 170 surrounds the electrical bus 106, except for the bus pin receiving receptacles 152, and covers the back side 140 of the conductive body 102. A front wall portion 176 covers the front side 178 of the conductive body 102 and includes an opening 180 at the entrance of the cavity 108 for permitting insertion of a cable conductor into the cavity 108. In a preferred embodiment, the opening 180 is provided with a sealing member 182 at the entrance of the cavity 108 to provide a moisture seal around the cable conductor. In a preferred embodiment, the sealing member 182 snugly and elastically fits around a cable conductor inserted therethrough. The sealing member 182 is formed of any suitable resilient material. Exemplary suitable materials include chemically cross-linked elastomers, physically cross-linked elastomers, and combinations and blends thereof. Exemplary materials include, but are not limited to, silicones, fluoro-elastomers, a terpolymer of ethylene-propylene-diene monomer (EPDM), rubbers, polyurethanes, and combinations and blends thereof. Suitable materials may further utilize fillers, reinforcing agents, cross-linkers, anti-oxidants and other low molecular weight constituents as may be necessary to achieve the desired physical sealing properties for sealing member 182. In some embodiments, an insulating gel or grease may further be provided within the cavity 108 to prevent moisture ingress.

As illustrated in FIGS. 5–8, the back wall portion 174 and front wall portion 176 of the insulative housing 170 are connected to the body portion 172 of the insulative housing 170 by screws, although other suitable means, such as adhesive, can be used to join the body portion 172, back wall portion 174 and front wall portion 176 of the insulative housing 170. In alternate embodiments, all or portions of the insulative housing 170 may be over-molded as a single piece on the conductive body 102, clamping member 104 and electrical bus 106.

The outer insulative housing 170 is optionally provided with latching means 186 for securing adjacent modular electrical connectors 100 to each other. In FIGS. 5–8, the latching means 186 are illustrated as U-shaped resilient arms 188 having barbed ends 190 extending from one side of the housing 170, and as slots 192 extending into an opposite side of the housing 170. The slots 192 are positioned and configured to receive and engage the barbed ends 190 of the U-shaped resilient arms of an adjacent modular electrical connector 100, such that the adjacent modular electrical connectors 100 are secured together. Two sets of U-shaped resilient arms 188 and slots 192 are illustrated, although more or fewer sets may be provided. The latching means 186 may be configured such that adjacent modular connectors 100 are inseparable after latching, or alternately such that the modular connectors 100 may later be separated without damage to the connectors. In alternate embodiments, the latching means 186 may comprise other known latch configurations.

Referring now to FIGS. 9–14, two modular electrical connectors 100*a*, 100*b* are shown in an engaged configuration. Each of the modular electrical connectors 100*a*, 100*b* are constructed as described above with respect to FIGS. 1–8, with the exception that the movable and fixed jaw portions 110, 112 of the clamping members 104 are shown without teeth.

Figure 9:
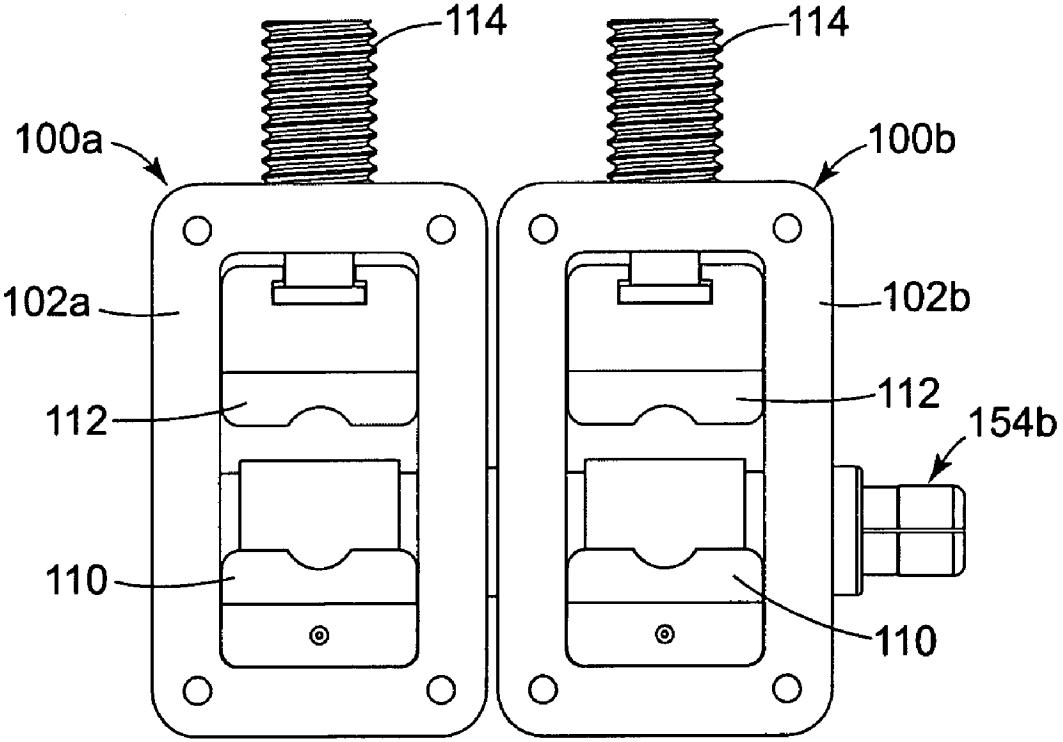
FIGS. 9–11 illustrate two of the modular electrical connectors of FIGS. 1–4 joined according to one embodiment of the invention, without an insulative housing, where.
Figure 10:
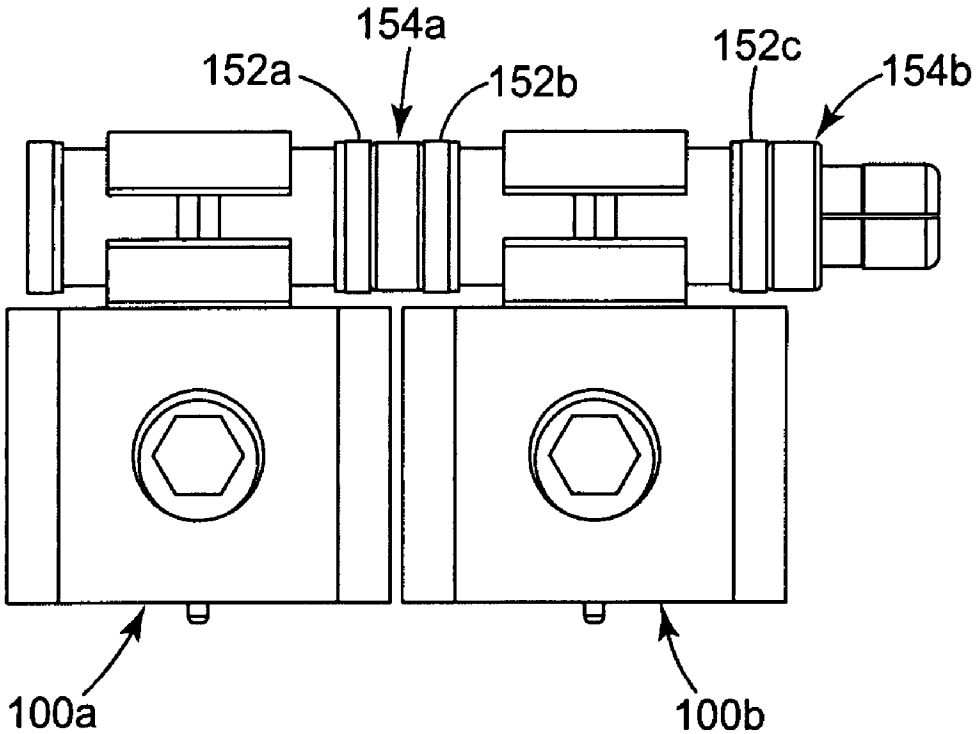
Figure 11:
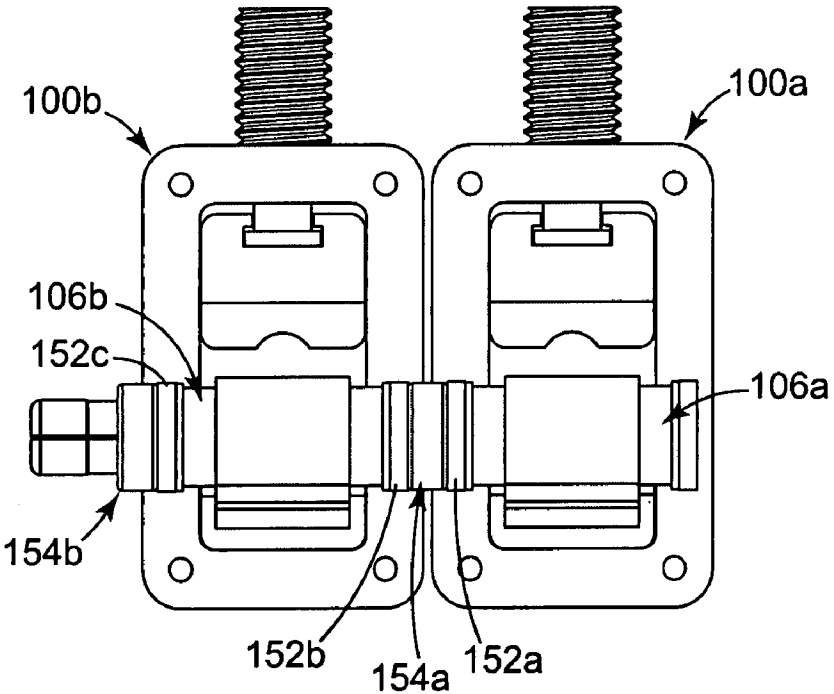

As best seen in FIGS. 9–11, the conductive bodies 102*a*, 102*b* of first and second modular electrical connectors 100*a*, 100*b* are mechanically and electrically connected by a first bus pin 154*a*. In the manner described above, the first bus pin 154*a* is engaged with and extends between adjacent receptacles 152*a* and 152*b* of the electrical buses 106*a*, 106*b* of the first and second modular connectors 100*a*, 100*b*, respectively. A second bus pin 154*b* is shown inserted into a second electrical bus receptacle 152*c* of the second modular connector 100*b*, in preparation for connection to a third modular electrical connector (not shown). If only two modular connectors are to be joined together, the second bus pin 154*b* need not be present.

Figure 12:
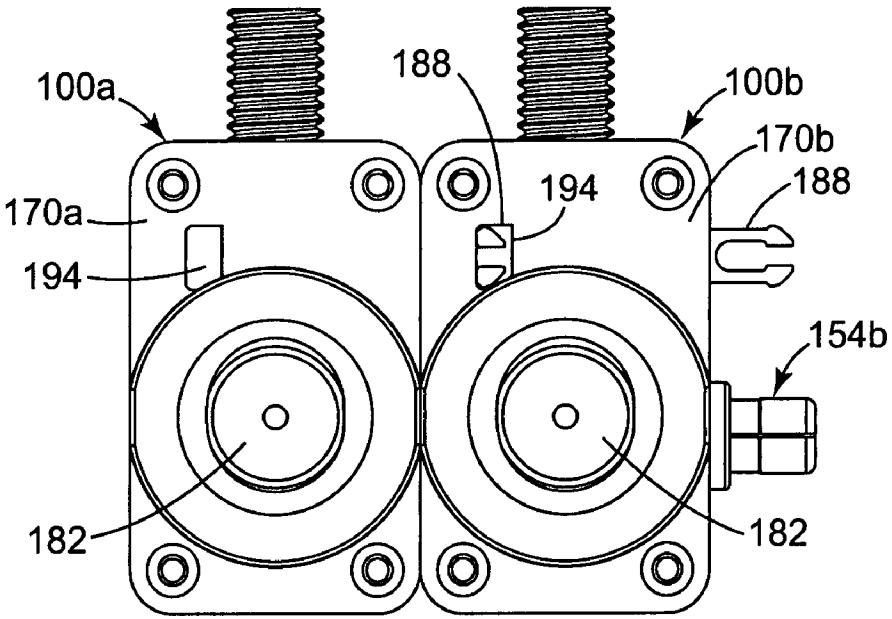
FIGS. 12–14 illustrate the two joined modular electrical connectors of FIGS. 9–11, with an insulative housing, where.
Figure 14:
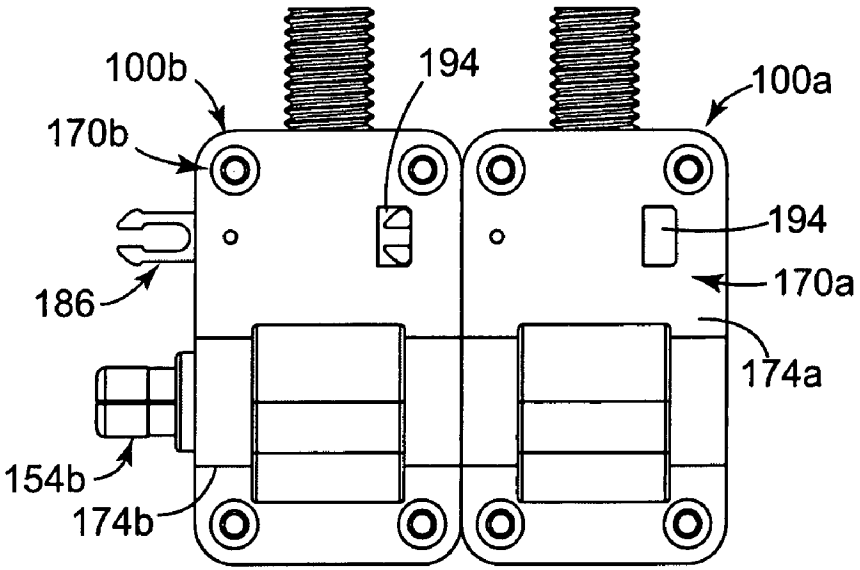
Figure 13:
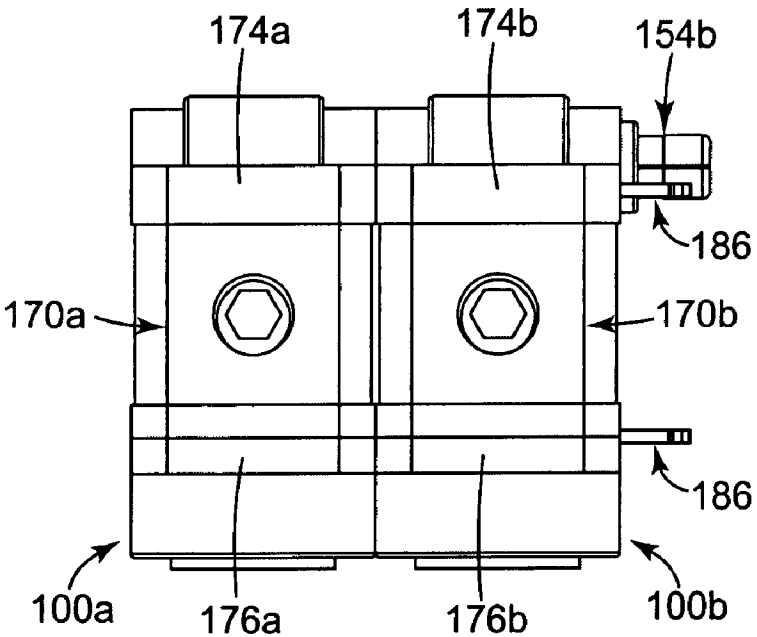

Referring to FIGS. 12–14, the engaged first and second modular connectors 100*a*, 100*b* are shown with their respective insulative outer housings 170*a*, 170*b*. The insulative outer housings 170*a*, 170*b* jointly cover the entirety of the first bus pin 154*a*, such that no portion of the first bus pin 154*a* is exposed. In one embodiment, a resilient sealing material as described above with respect to sealing member 182, or insulating gel or grease, may be provided around the engaging elements of electrical bus 106, to prevent moisture ingress. In addition to the mechanical connection afforded by the first bus pin 154*a*, the first and second modular connectors 100*a*, 100*b* are mechanically joined by the latching means 186. As best seen in FIGS. 13 and 14, the back wall portion 174*a*, 174*b* and the front wall portion 176*a*, 176*b* of each of the insulative housings 170*a*, 170*b* are provided with openings 194 to access the U-shaped resilient arms 188 of the latching means, such that the resilient arms 188 may be disengaged from the mating slot 192 by insertion of a tool into the corresponding opening 194.

Figure 15:
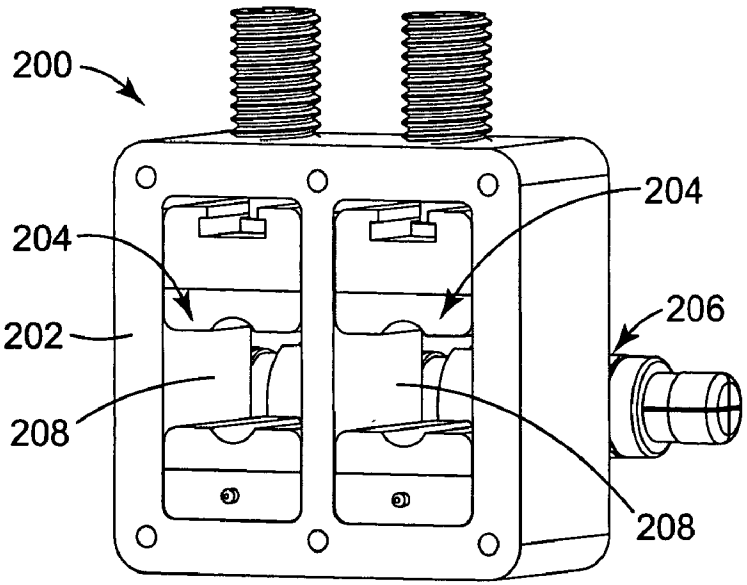
FIG. 15 is a right front side perspective view of another embodiment of a modular electrical connector according to the invention, illustrating a dual cable modular electrical connector, without an insulative housing.

Because branching a cable conductor typically involves at least three cables (one incoming and at least two outgoing), three or more modular connectors 100 of the embodiment illustrated in FIGS. 1–14 would typically be used to branch a cable. However, in another embodiment, the conductive body is configured to accept two or more cable conductor ends. In FIG. 15, modular electrical connector 200 having a conductive body 202 is illustrated as having two adjacent cavities 208, where each cavity 208 is configured to receive a respective conductive cable end. Alternately, the conductive body 202 may have a single enlarged cavity, where the cavity is configured to receive more than one conductor cable end. A clamping member 204 is provided for each cable conductor, and a single electrical bus 206 is provided on the conductive body 202. The clamping members 204 and electrical bus 206 are constructed like those described with reference to FIGS. 1–4.

Figure 16:
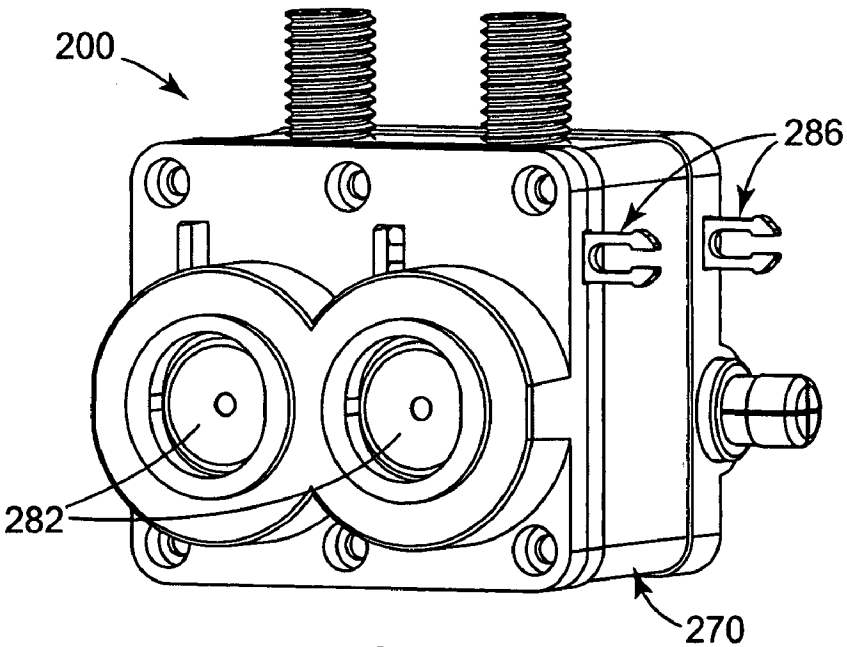
FIG. 16 is a right front side perspective view of the dual cable modular electrical connector of FIG. 15, with an insulative housing.

In FIG. 16, the conductive body 202, clamping member 204 and electrical bus 206 of FIG. 15 are shown enclosed within an insulative housing 270. The insulative housing 270 is constructed like that described with reference to FIGS. 5–8, and preferably includes a sealing member 282 at the entrance of the each cavity 208 to provide a moisture seal around each cable conductor. The outer housing 270 is similarly provided with latching means 286 for securing adjacent modular electrical connectors to each other. The dual cable modular connector 200 of FIGS. 15 and 16 is connectable to other modular connectors in the manner described above with reference to FIGS. 9–14. The dual modular connector 200 illustrated in FIGS. 15 and 16 may be connected with similar dual module connectors, or may be connected to the single cable modular connector 100 illustrated in FIGS. 1–8.

Figure 18:
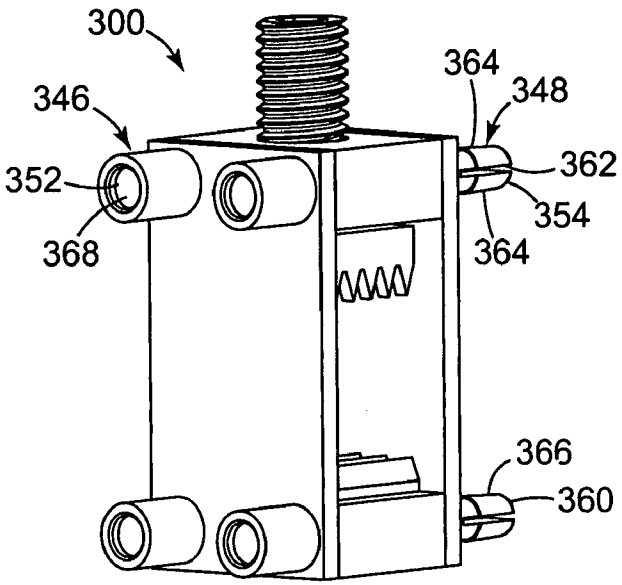
FIGS. 17–19 illustrate another embodiment of a modular electrical connector according to the invention, without an insulative housing, where.
Figure 19:
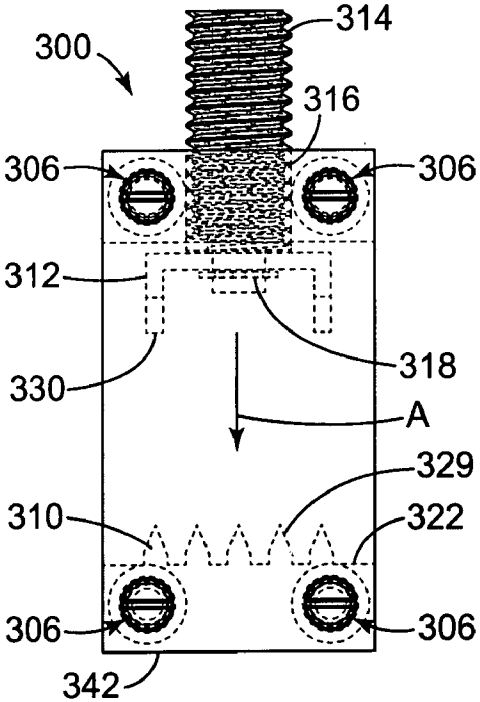
Figure 17:
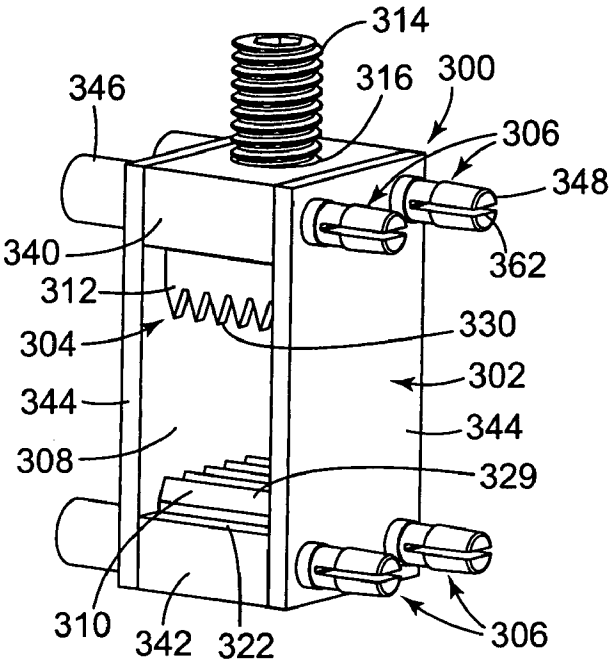

FIGS. 17–25 illustrate another exemplary embodiment of a modular electrical connector 300 according to the invention. As best seen in FIGS. 17–19, the modular electrical connector 300 includes a conductive body 302, a clamping member 304, and at least one electrical bus 306. The conductive body 302 is assembled from a top wall 340, a bottom wall 342, and two sidewalls 344. The top wall 340, bottom wall 342, and sidewalls 344 define a cavity 308 that extends longitudinally through the body 302.

The clamping member 304 is positioned within the cavity 308, and includes a fixed jaw portion 310 and a movable jaw portion 312. As illustrated, the fixed jaw portion 310 is integrally formed with bottom wall 342. Movable jaw portion 312 is a U-shaped member that moves transversely to a longitudinal axis of the cavity 308, and is actuated by a threaded bolt 314 extending through a threaded bore 316 in the top wall 340 of body 302. The bolt 314 and movable jaw portion 312 are operably joined at a rotatable joint 318, such that the bolt 314 may rotate along its longitudinal axis relative to the movable jaw portion 312. As the bolt 314 is turned and advanced into the cavity 308, the movable jaw portion 312 of the clamping member 304 moves in the direction of arrow A and clamps a cable conductor (not shown) between the moveable jaw portion 312 and the fixed jaw portion 310 on the opposed inner surface 322 of the cavity 308. Likewise, when the bolt 314 is turned and retracted from the cavity 308, the movable jaw portion 312 loosens from the cable conductor. As described above with reference to FIGS. 1–4, the bolt 314 may have a torque limiting head (not shown) to precisely limit the force applied by the bolt.

The fixed and movable jaw portions 310, 312 of the clamping member 304 may be of any suitable configuration for establishing electrical and mechanical connection with the cable conductor. In a preferred embodiment, the jaw portions 310, 312 of the clamping member 304 form an insulation piercing connector (IPC). As best seen in FIGS. 17–19, fixed jaw portion 310 is provided with ridges 329 and moveable jaw portion 312 is provided with teeth 330, to pierce an insulative covering of the cable conductor and make electrical contact with the conductive core of the cable as the clamping member 304 is tightened upon the cable conductor. The ridges 329 and teeth 330 may be formed in any suitable manner, such as by molding, machining, extruding, or a combination thereof. The shape, size and orientation of the ridges 329 and teeth 330 are influenced by the construction of the cable to be clamped. In other embodiments, when the cable conductor is stripped of insulation and the bare conductor is inserted into the cavity, the sharpened ridges 329 and teeth 330 may not be necessary to establish sufficient mechanical and electrical connection between the clamping member 304 and the cable conductor.

As best seen in FIGS. 17–19, four separate electrical buses 306 are provided on conductive body 302, although more or less than four electrical buses may be provided in alternate embodiments. Each electrical bus 306 comprises a first electrical bus portion 346 on a first side of the body 302, and a second electrical bus portion 348 on a second side of the body 302. Each first electrical bus portion 346 is positioned and configured to make mechanical and electrical connection with a corresponding second electrical bus portion 348 on a mating modular electrical connector 300 (described below in greater detail with reference to FIGS. 22–25). The first and second electrical bus portions 346, 348 may be separately formed from body 306 and attached to body 306 by suitable means, such as screwing or welding, or may be integrally formed with body 306 as a monolithic structure.

In the embodiment of FIGS. 17–25, each of the first electrical bus portions 346 is a female connector element, specifically a receptacle 352, while each of the second electrical bus portions 348 is a male connector element, specifically a pin 354. Each receptacle 352 is configured for receiving a corresponding mating pin 354 therein. The end 360 of each pin 354 is provided with one or more slots 362 along the longitudinal axis of the pin 354, such that resiliently deflectable arm members 364 are provided at the end 360 of the pin 354. In FIGS. 17–25, the pin 354 is illustrated as having one slot 362 forming two resiliently deflectable arm members 364 at the end 360 of each pin 354. The resiliently deflectable arm members 364 may be compressed together slightly as the pin 354 is inserted into the receptacle 352 of first bus portion 346, such that a compressive force is created between the resilient arm members 364 and the receptacle 352. In a preferred embodiment, the end 360 of each pin 354 is provided with an enlarged circumferential ridge 366 and the receptacles 352 have a corresponding recess 368, such that when the pin 354 is fully inserted into the receptacle 352, the enlarged circumferential ridge 366 locks into the corresponding recess 368 of the receptacle 352. The shapes of the pin 354 and mating receptacle 352 may be selected such that the pin 354 and receptacle 352 are inseparable after engagement, or alternately such that the pin 354 and receptacle 352 may later be separated without damage to the connectors 300.

Figure 21:
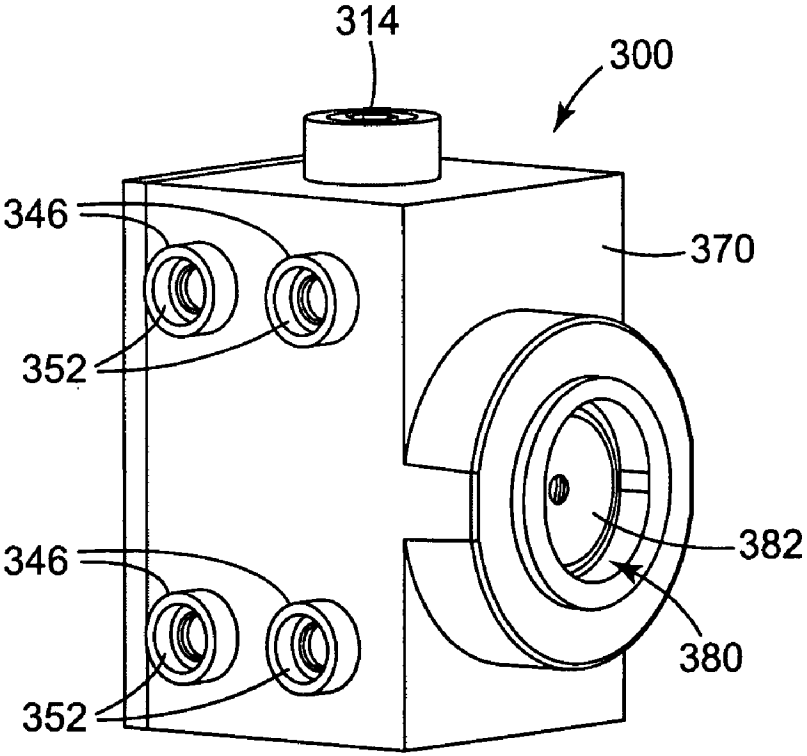
FIGS. 20–21 illustrate the modular electrical connector of FIGS. 17–19, with an insulative housing, where.
Figure 20:
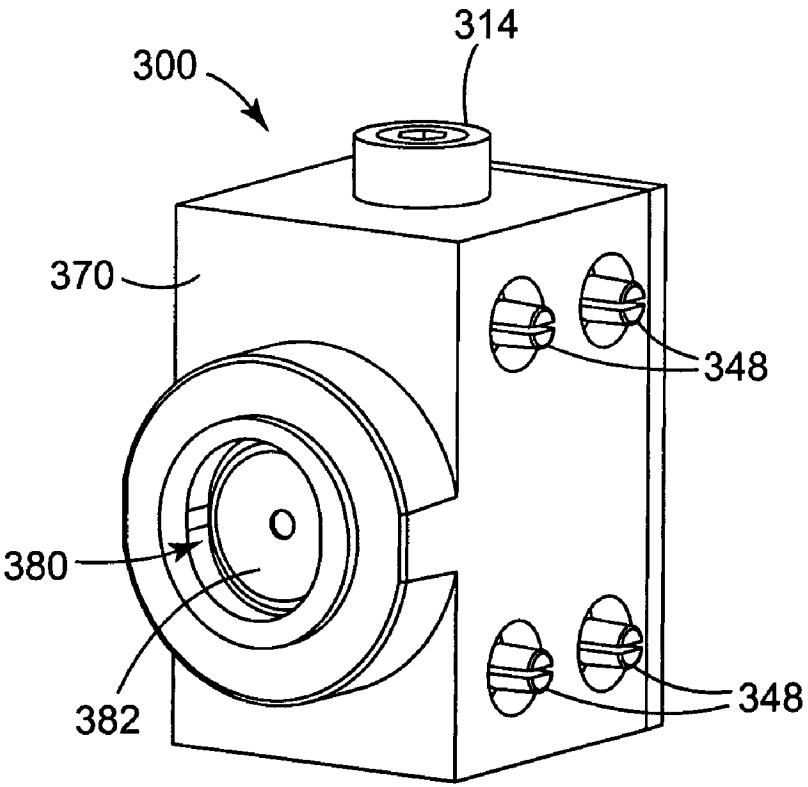

Referring now to FIGS. 20–21, the conductive body 302, clamping member 304 and electrical buses 306 of FIGS. 17–19 are shown enclosed in an insulative outer housing 370. The outer insulative housing 370 is formed in a manner consistent with the above-described insulative outer housing 170 of FIGS. 5–8 and 12–14. The housing 370 includes an opening 380 at the entrance of the cavity 308 for permitting insertion of a cable conductor into the cavity 308. In a preferred embodiment, the opening 380 is provided with a sealing member 382 to provide a moisture seal around the cable conductor. The opening 380 and sealing member 382 are formed in a manner consistent with the opening 180 and sealing member 182 of FIGS. 5–8 and 12–14.

Figure 23:
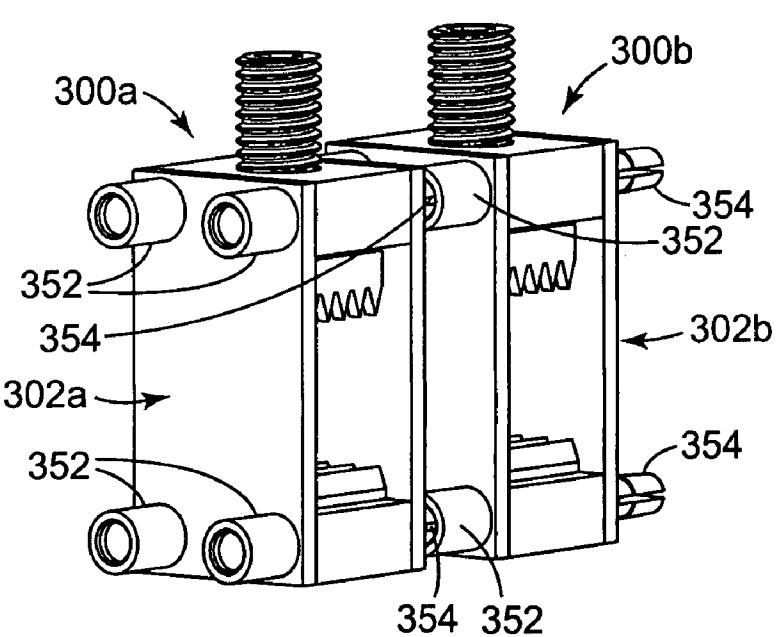
FIGS. 22–23 illustrate two of the modular electrical connectors of FIGS. 17–19 joined according to one embodiment of the invention, without an insulative housing, where.
Figure 22:
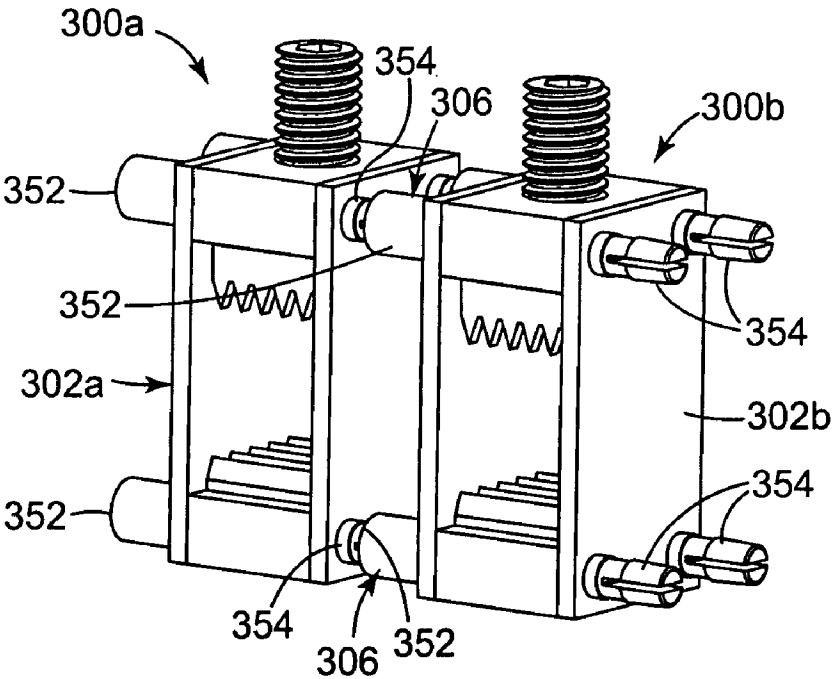

Referring now to FIGS. 22–25, two modular electrical connectors **300*a*, 300*b* are shown in an engaged configuration. Each of the modular electrical connectors 300*a*, 300*b* is constructed as described above with respect to FIGS. 17–21. As best seen in FIGS. 22–23, the conductive bodies 302*a*, 302*b* of first and second modular electrical connectors 300*a*, 300*b* are mechanically and electrically connected by the plurality of electrical busses 306. The pins 354 of each electrical bus 306 on the first modular connector 300*a* are engaged with corresponding receptacles 352 of the mating second modular connector 300*b***. Additional modular connectors (not shown) may be added to the assembly in a similar manner.

The plurality of electrical busses 306 on each modular connector 300 provide several benefits, including increased current carrying capacity, increased mechanical joint strength, and a resistance to rotation of the modular connectors **300*a*, 300*b* relative to each other. If the plurality of electrical busses 306 are arranged in an ordered fashion, the modular connectors 300*a*, 300*b* may be engaged with each other at incremental angles. For example, the illustrated rectangular arrangement of electrical busses 306 on housing 302 permits modular connectors 300*a*, 300*b* to be engaged at 180 degree increments. If electrical busses 306 were arranged on housing 302 in a square pattern, modular connectors 300*a*, 300*b*** could be engaged at 90 degree increments. Such incremental engagement angles are particularly beneficial when it is desired to route branched cable conductors in different directions, and particularly where the space available to form the branch is limited.

Figure 25:
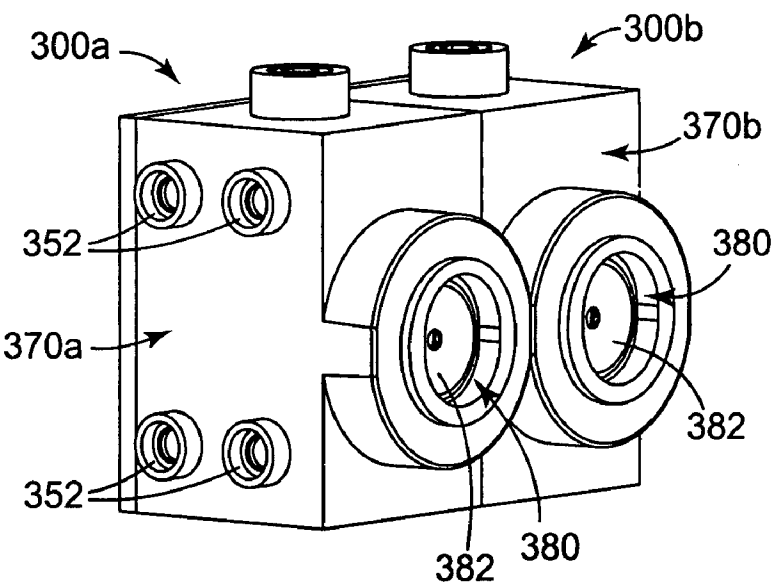
FIGS. 24–25 illustrate the two joined modular electrical connectors of FIGS. 22–23, with an insulative housing, where.
Figure 24:
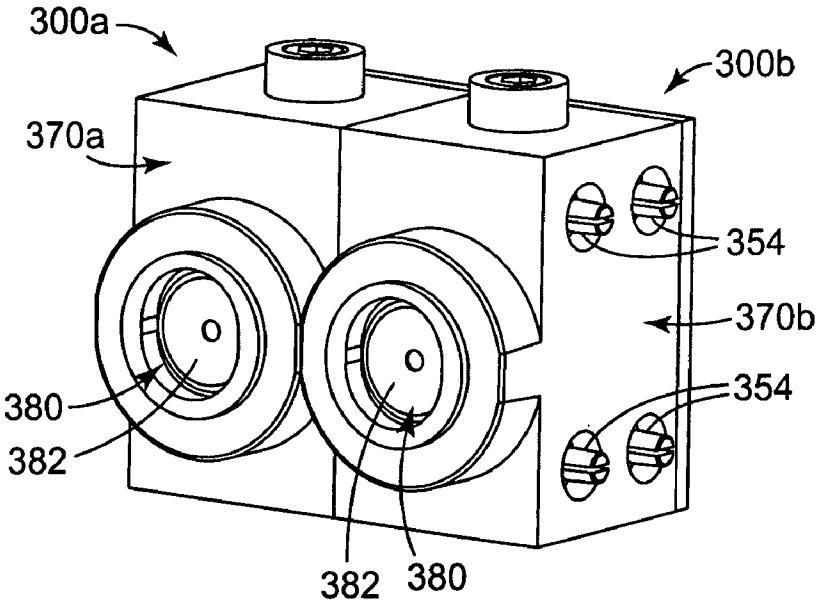

Referring to FIGS. 24–25, the engaged first and second modular connectors **300*a*, 300*b* are shown with their respective insulative outer housings 370*a*, 370*b*. The insulative outer housings 370*a*, 370*b* jointly cover the entirety of the engaged pins 354 and receptacles 352**.

The modular electrical connector 300 may be adapted to receive more than one conductive cable end, either by providing a plurality of cavities 308 within the body 302, or enlarging the cavity 308 to accept more than one conductive cable end, and providing a clamping member 304 for each cable conductor.

Figure 27:
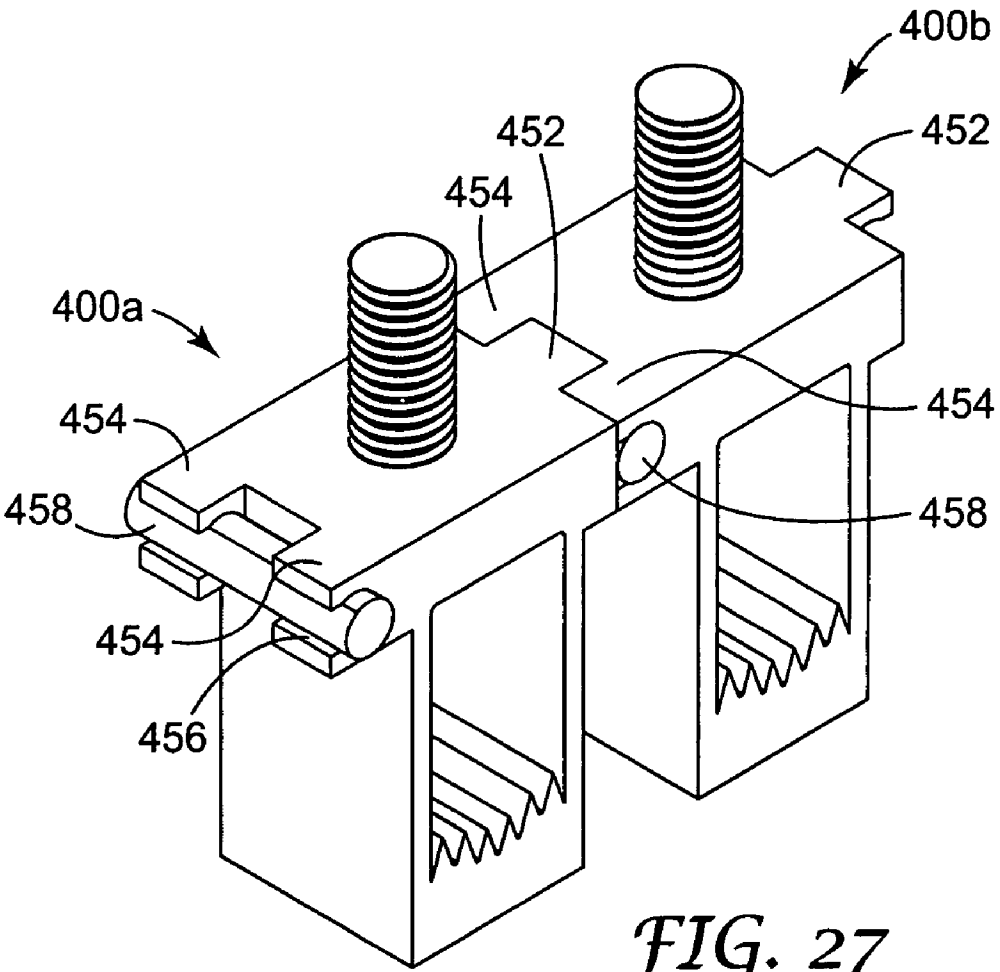
FIGS. 26–27 illustrate another embodiment of a modular electrical connector according to the invention, without an insulative housing, where.
Figure 26:
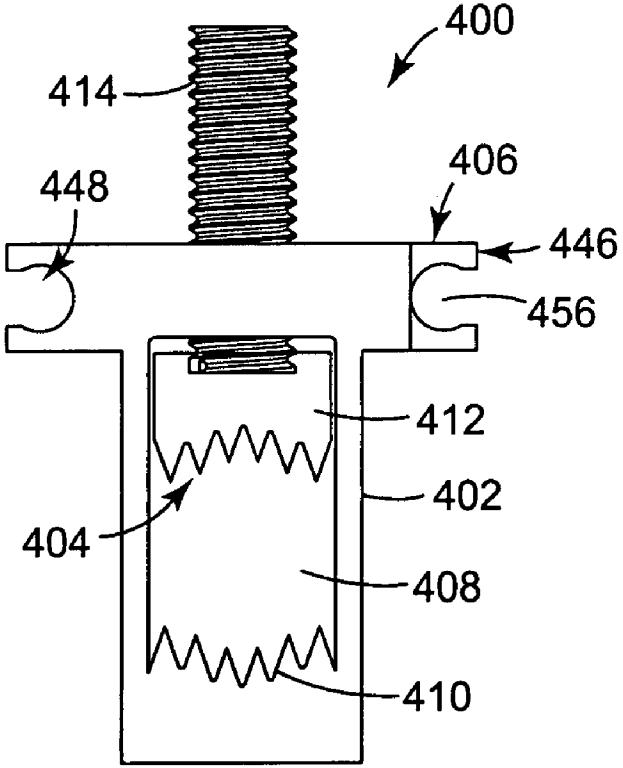

FIGS. 26–27 illustrate another exemplary embodiment of a modular electrical connector 400 according to the invention. The modular electrical connector 400 includes a conductive body 402, a clamping member 404, and an electrical bus 406. A cavity 408 extends longitudinally through the body 402 for receiving an end of a cable conductor. The clamping member 404 is positioned within the cavity 408, and is formed and operates like either of the clamping members 104, 304 described above, including a fixed jaw portion 410, a movable jaw portion 412, and an actuating bolt 414.

The electrical bus 406 comprises a first electrical bus portion 446 on a first side of the body 402, and a second electrical bus portion 448 on a second side of the body 402. The first electrical bus portion 446 is positioned and configured to make mechanical and electrical connection with the second bus portion 448 of a mating modular connector 400. The first and second electrical bus portions 446, 448 may be separately formed from body 406 and attached to body 406 by suitable means, such as screwing or welding, but are preferably integrally formed with body 406 as a monolithic structure.

In the embodiment of FIGS. 26–27, the first electrical bus portion 446 comprises a laterally extending rail 452, and second electrical bus portion 448 comprises a pair of laterally extending rails 454. The rails 452, 454 are positioned such the rails 452, 454 of mating modular connectors 400*a*, 400*b* to interlace with each other. A mating face of each of the rails 452, 454 is provided with a keyway 456 for receiving a locking pin 458. After rails 452, 454 are interlaced, locking pin 458 is inserted in keyway 456 to maintain modular connectors 400*a*, 400*b* in a joined configuration. Additional modular connectors (not shown) may be added to the assembly in a similar manner.

The conductive body 402 may be enclosed in an insulative outer housing (not shown) like that described above with respect to housings 170 and 370, including an opening having a sealing member to provide a moisture seal around the cable conductor.

Figure 29:
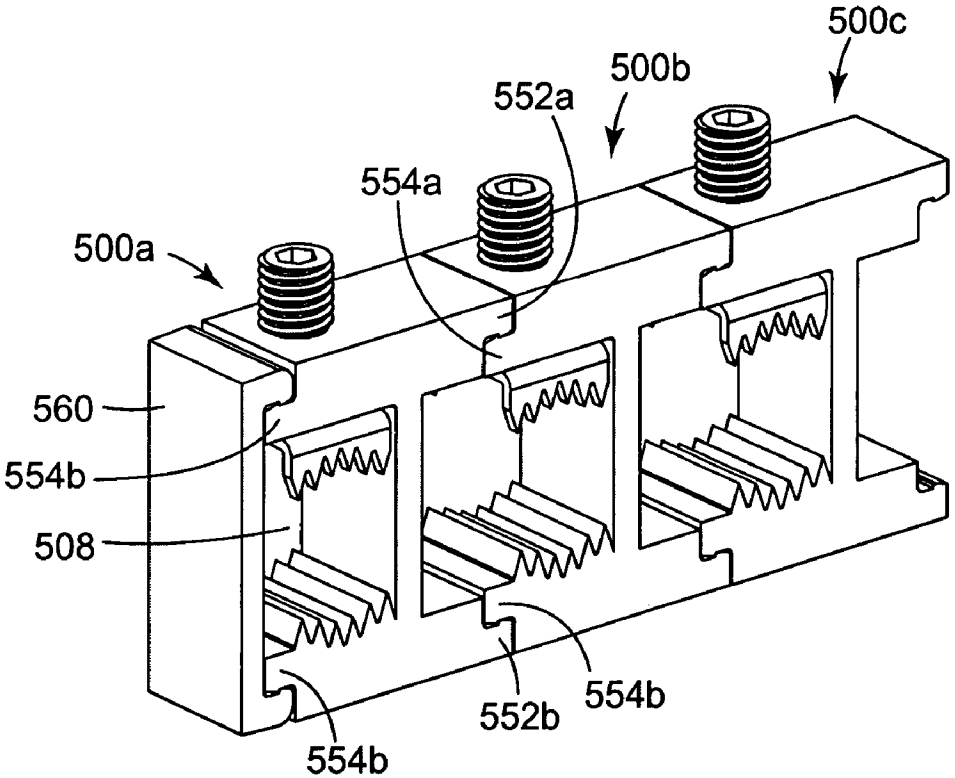
FIGS. 28–29 illustrate another embodiment of a modular electrical connector according to the invention, without an insulative housing, where.
Figure 28:
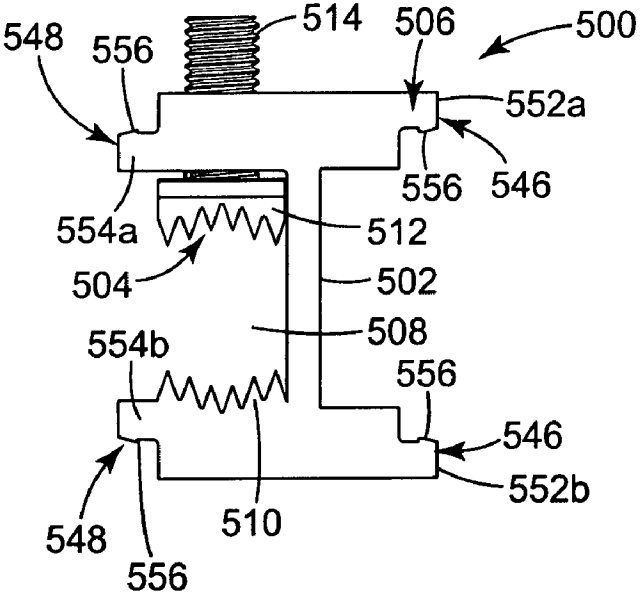

FIGS. 28–29 illustrate another exemplary embodiment of a modular electrical connector 500 according to the invention. The modular electrical connector 500 includes a conductive body 502, a clamping member 504, and an electrical bus 506. A cavity 508 extends longitudinally through the body 502 for receiving an end of a cable conductor. The clamping member 504 is positioned within the cavity 508, and is formed and operates like either of the clamping members 104, 304 described above, including a fixed jaw portion 510, a movable jaw portion 512, and an actuating bolt 514.

The electrical bus 506 comprises a first electrical bus portion 546 on a first side of the body 502, and a second electrical bus portion 548 on a second side of the body 502. The first electrical bus portion 546 is positioned and configured to make mechanical and electrical connection with the second bus portion 548 of a mating modular connector 500. In the illustrated embodiment, the first electrical bus portion 546 and the second electrical bus portion 548 are similarly shaped (i.e., hermaphroditic). The first and second electrical bus portions 546, 548 are integrally formed with body 506 as a monolithic structure.

In the embodiment of FIGS. 28–29, the first electrical bus portion 546 comprises an upper laterally extending rail 552*a* and a lower laterally extending rail 552*b*. The second electrical bus portion 548 comprises an upper laterally extending rail 554*a* and a lower laterally extending rail 554*b*. The ends of rails 552*a*, 552*b*, 554*a*, 554*b* are each provided with a ramped lip 556. The first and second electrical bus portions 546, 548 are positioned such the rails 552*a*, 552*b* of a first modular connector 500*a* engage rails 554*a*, 554*b* of a second modular connector 500*b* when the connectors 500*a*, 500*b* are pressed together. The ramped lips 556 of the mating rails engage each other and maintain modular connectors 500*a*, 500*b* in a joined configuration. Preferably, the mating rails are resiliently deflected when in an engaged position, such that a contact force is maintained between the mating rails. Additional modular connector 500*c* is added to the assembly in a similar manner. A C-shaped end member 560 is engaged with the rails 554*a*, 554*b* at the open side of the cavity 508, to prevent deformation of the body 502 as the clamp member 504 is tightened on the cable conductor.

The conductive body 502 may be enclosed in an insulative outer housing (not shown) like that described above with respect to housings 170 and 370, including an opening having a sealing member to provide a moisture seal around the cable conductor.

Figure 31:
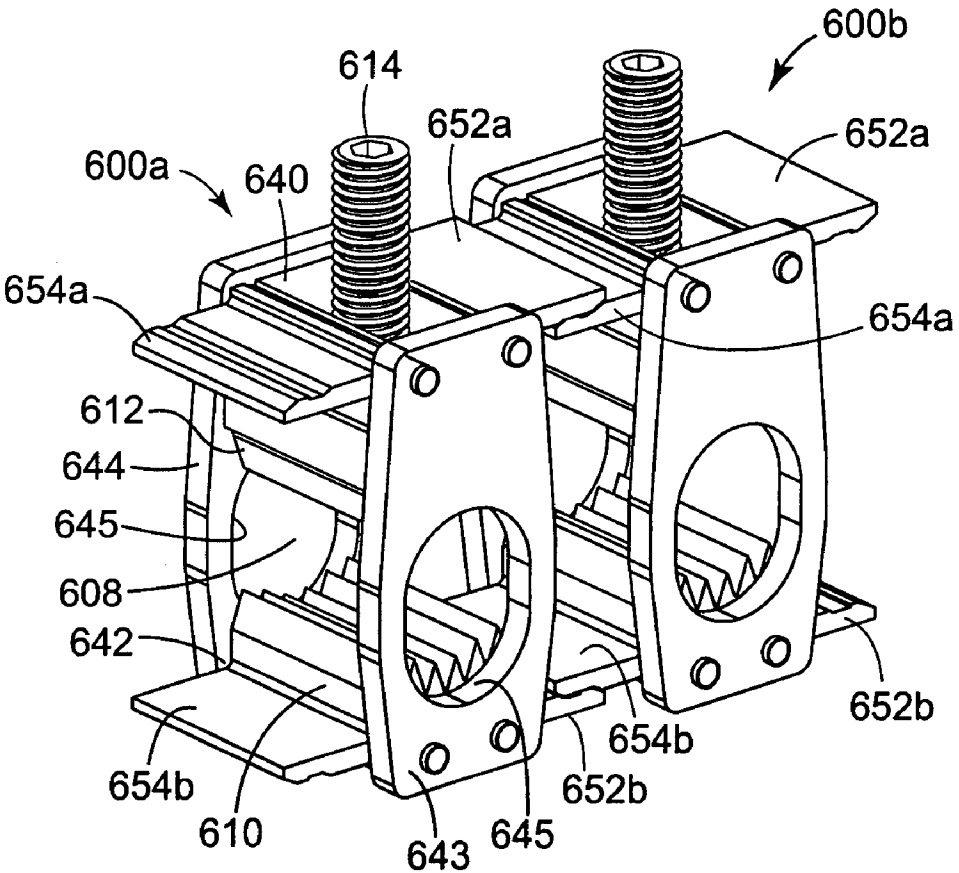
FIGS. 30–31 illustrate another embodiment of a modular electrical connector according to the invention, without an insulative housing, where.
Figure 30:
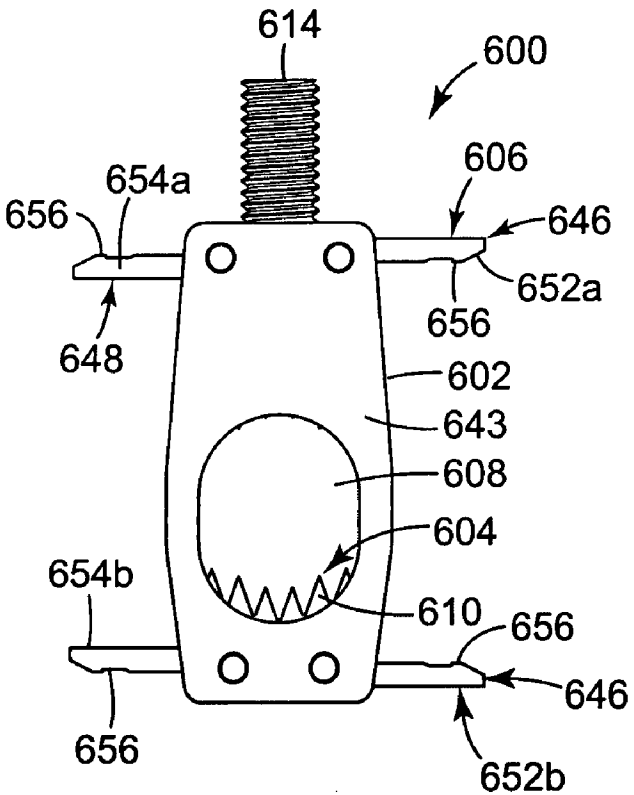

FIGS. 30–31 illustrate another exemplary embodiment of a modular electrical connector 600 according to the invention. The modular electrical connector 600 includes a conductive body 602, a clamping member 604, and an electrical bus 606. The conductive body 602 is assembled from a top wall 640, a bottom wall 642, front wall 643 and back wall 644. Front wall 643 and back wall 644 include openings 645 allowing an end of a cable conductor entry into a cavity 608 within the body 602. The clamping member 604 is positioned within the cavity 608, and is formed and operates like either of the clamping members 104, 304 described above, including a fixed jaw portion 610, a movable jaw portion 612, and an actuating bolt 614.

The electrical bus 606 comprises a first electrical bus portion 646 on a first side of the body 602, and a second electrical bus portion 648 on a second side of the body 602. The first electrical bus portion 646 is positioned and configured to make mechanical and electrical connection with the second bus portion 648 of a mating modular connector 600.

In the embodiment of FIGS. 30–31, the first electrical bus portion 646 and the second electrical bus portion 648 are similarly shaped (i.e., hermaphroditic). The first electrical bus portion 646 comprises an upper laterally extending rail 652*a* and a lower laterally extending rail 652*b*. The second electrical bus portion 648 comprises an upper laterally extending rail 654*a* and a lower laterally extending rail 654*b*. The ends of rails 652*a*, 652*b*, 654*a*, 654*b* are each provided with a ramped lip 656. The upper laterally extending rails 652*a* and 654*a* are integrally formed with top wall 640, while lower laterally extending rails 652*b* and 654*b* are integrally formed with bottom wall 642. The upper and lower rails 652*a*, 652*b* of a first modular connector 600*a* engage upper and lower rails 654*a*, 654*b* of a second modular connector 600*b* when the connectors 600*a*, 600*b* are pressed together. The ramped lips 656 of the mating rails engage each other and maintain modular connectors 600*a*, 600*b* in a joined configuration. Preferably, the mating rails are resiliently deflected when in an engaged position, such that a contact force is maintained between the mating rails Additional modular connectors (not shown) may be added to the assembly in a similar manner.

The conductive body 602 may be enclosed in an insulative outer housing (not shown) like that described above with respect to housings 170 and 370, including an opening having a sealing member to provide a moisture seal around the cable conductor.

Figure 33:
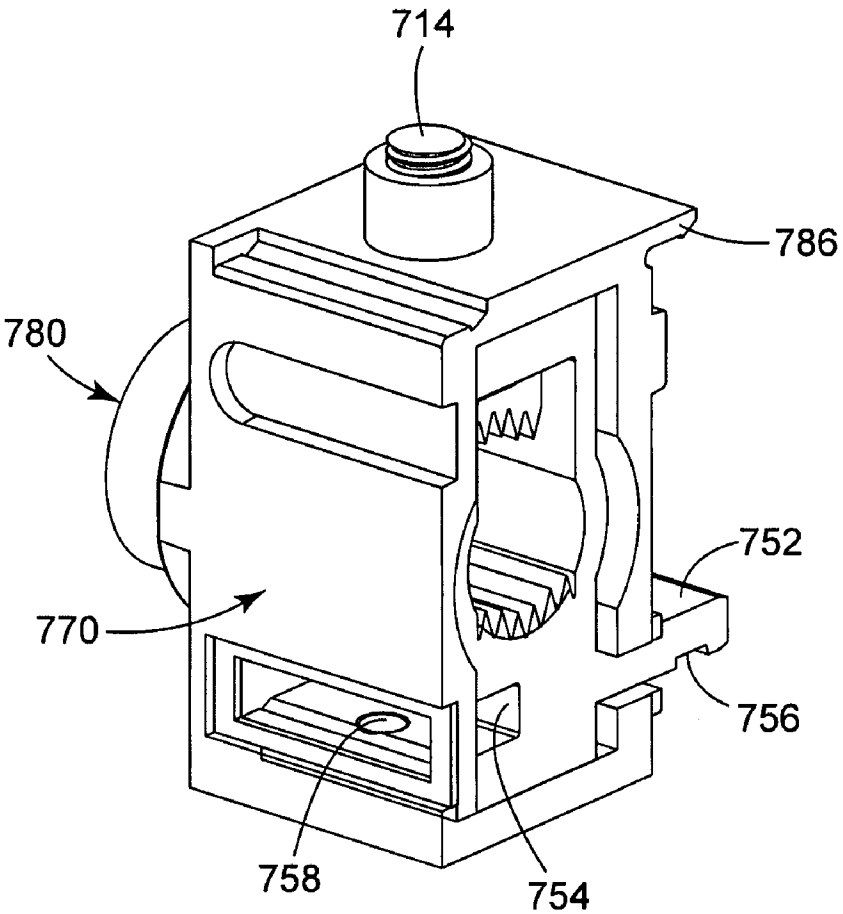
FIGS. 32–34 illustrate another embodiment of a modular electrical connector according to the invention, where.
Figure 32:
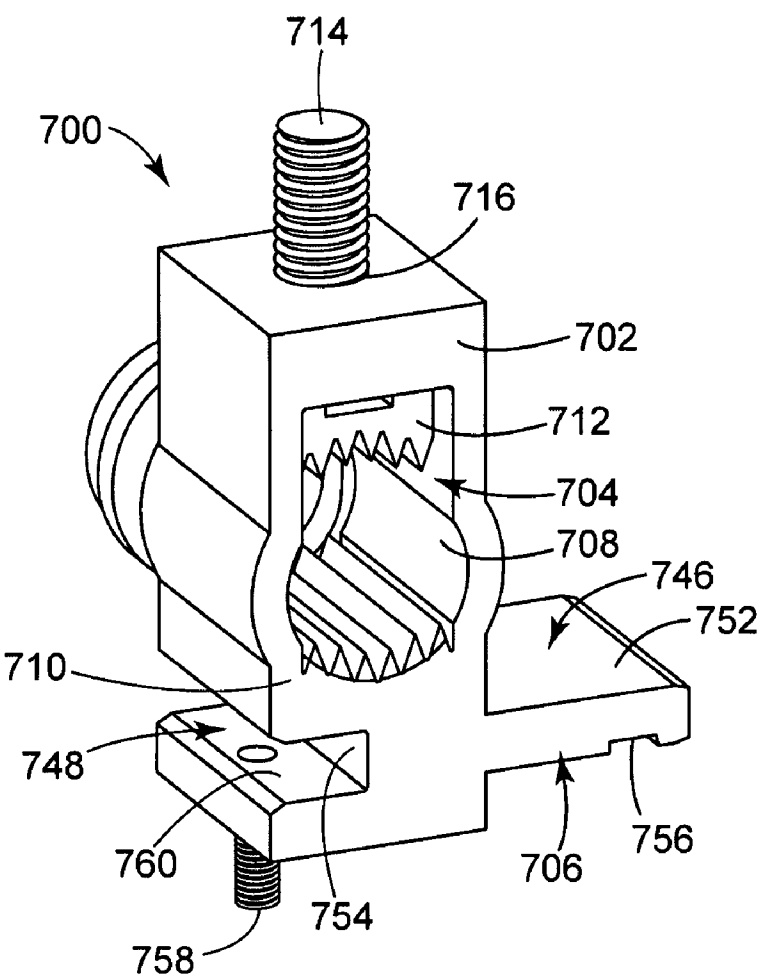
Figure 34:
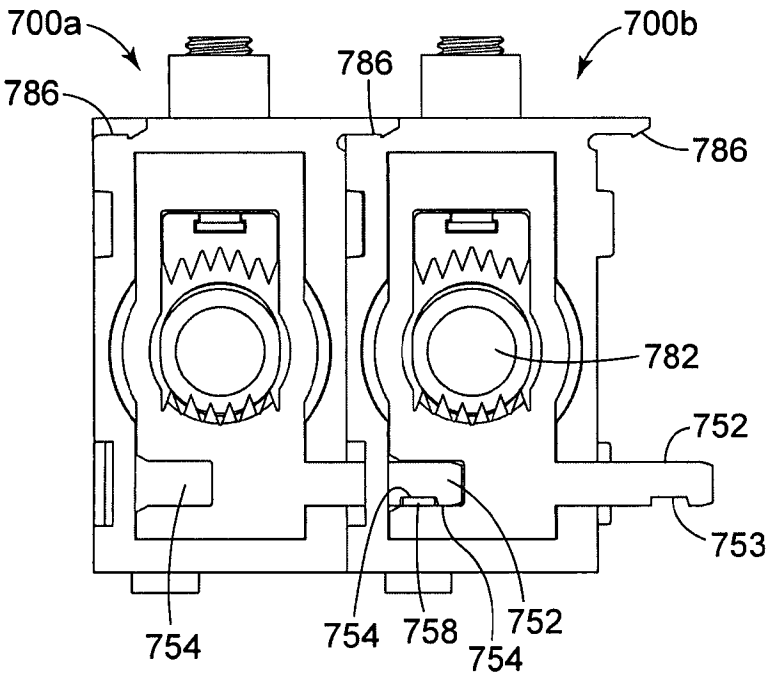

FIGS. 32–34 illustrate another exemplary embodiment of a modular electrical connector 700 according to the invention. The modular electrical connector 700 includes a conductive body 702, a clamping member 704, and an electrical bus 706. The conductive body 702 is a unitary member having a cavity 708 that extends longitudinally through the body 702.

The clamping member 704 is positioned within the cavity 708, and includes a fixed jaw portion 710 and a movable jaw portion 712. The fixed jaw portion 710 is integrally formed with the body 702. Movable jaw portion 712 is formed and operates in a manner like that described above with respect to movable jaw portion 112 in FIGS. 1–4, and is actuated by a threaded bolt 714 extending through a threaded bore 716 in the body 702.

The electrical bus 706 comprises a first electrical bus portion 746 on a first side of the body 702, and a second electrical bus portion 748 on a second side of the body 702. The first electrical bus portion 746 is positioned and configured to make mechanical and electrical connection with the second bus portion 748 of a mating modular connector 700.

In the embodiment of FIGS. 32–34, the first electrical bus portion 746 comprises a laterally extending rail 752, and the second electrical bus portion 748 comprises a slot 754 in the body 702 for receiving a mating rail 752. The end of rail 752 is provided with groove 756, and the slot 754 is provided with a set screw 758 threaded through a bottom wall 760 of the slot 754. As best seen in FIG. 34, in use the rail 752 of a first modular connector 700*a* enters the slot 754 of a second modular connector 700*b*. The set screw 758 is advanced into the slot 754 such that the set screw 758 engages the groove 756 of rail 752, thereby maintaining modular connectors 700*a*, 700*b* in a joined configuration. Additional modular connectors (not shown) may be added to the assembly in a similar manner.

Referring to FIG. 33, the conductive body 702 may be enclosed in an insulative outer housing 770 like that described above with respect to housings 170 and 370, including an opening 780 having a sealing member 782 to provide a moisture seal around the cable conductor. Housing 770 may optionally be provided with latch means 786 for providing additional mechanical engagement between mating modular connectors 700*a*, 700*b*. In FIGS. 33 and 34, the back wall of the housing 770 has been removed to allow viewing the inside of the modular connector 700.

Figure 35:
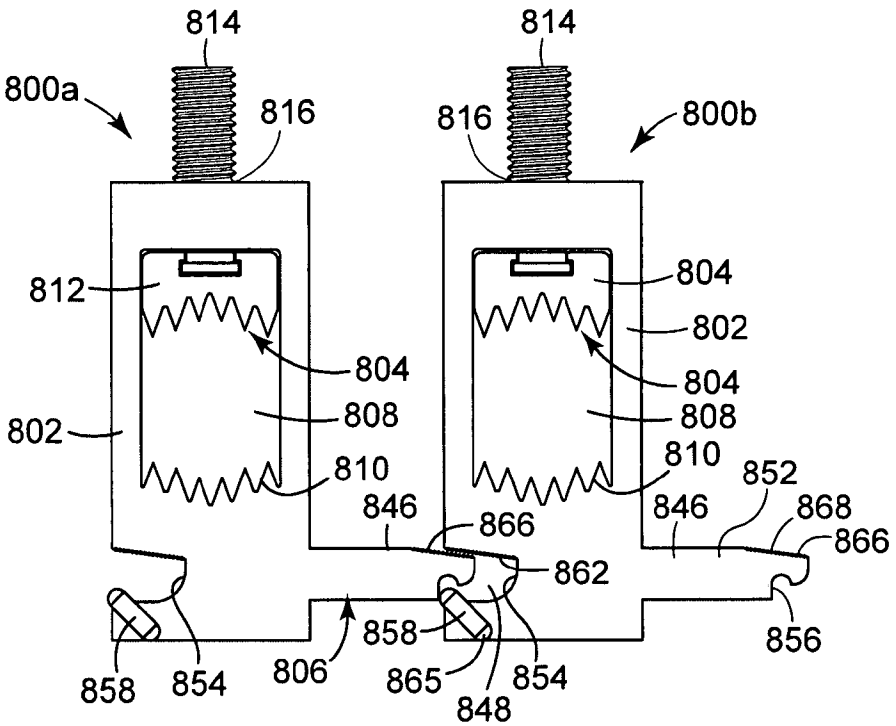
FIGS. 35–37 illustrate another embodiment of a modular electrical connector according to the invention, where.
Figure 36:
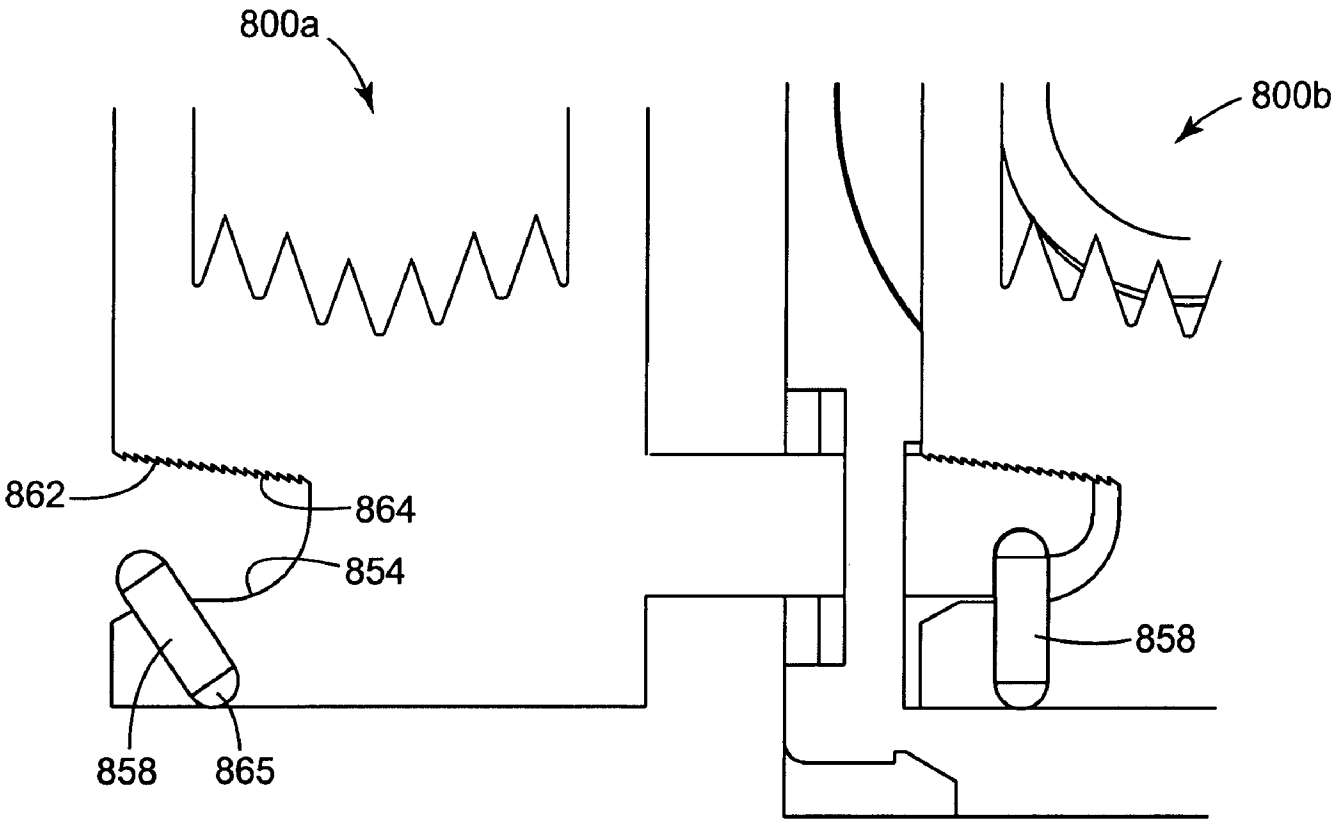
Figure 37:
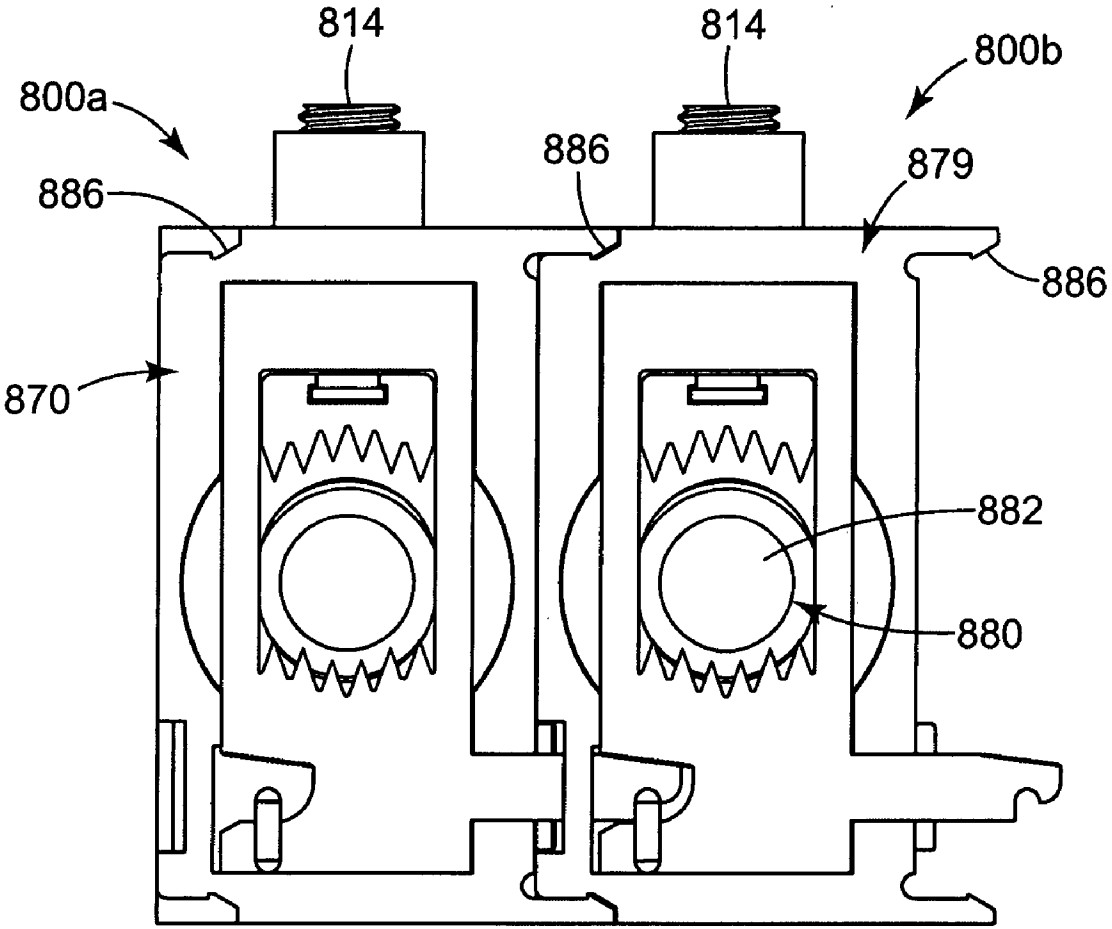
Figure 40:
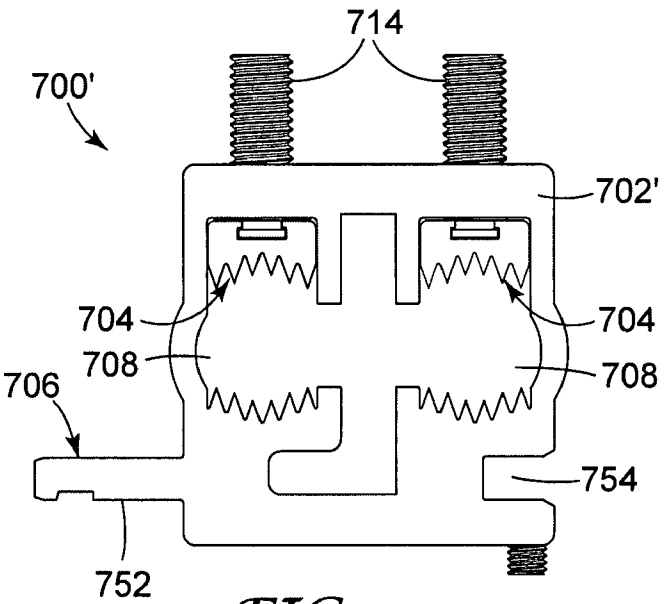
FIG. 40 is a front elevational view of another embodiment of a modular electrical connector according to the invention, illustrating a dual cable modular electrical connector, without an insulative housing.

FIGS. 35–37 illustrate another exemplary embodiment of a modular electrical connector 800 according to the invention. The modular electrical connector 800 includes a conductive body 802, a clamping member 804, and an electrical bus 806. The conductive body 802 is a unitary member having a cavity 808 that extends longitudinally through the body 802.

The clamping member 804 is positioned within the cavity 808, and includes a fixed jaw portion 810 and a movable jaw portion 812. The fixed jaw portion 810 is integrally formed with the body 802. Movable jaw portion 812 is formed and operates in a manner like that described above with respect to movable jaw portion 112 in FIGS. 1–4, and is actuated by a threaded bolt 814 extending through a threaded bore 816 in the body 802.

The electrical bus 806 comprises a first electrical bus portion 846 on a first side of the body 802, and a second electrical bus portion 848 on a second side of the body 802. The first electrical bus portion 846 is positioned and configured to make mechanical and electrical connection with the second bus portion 848 of a mating modular connector 800.

In the embodiment of FIGS. 35–37, the first electrical bus portion 846 comprises a laterally extending rail 852, and the second electrical bus portion 848 comprises a slot 854 in the body 802 for receiving a mating rail 852. The end of rail 852 is provided with groove 856, and the slot 854 is provided with a toggle latch 858 rotatably mounted in a bottom wall 860 of the slot 854. In use, the rail 852 of a first modular connector 800*a* is pressed into the slot 854 of a second modular connector 800*b*. As the rail 852 advances into the slot 854, the groove 856 of the rail 852 captures the toggle latch 858. As the rail 852 continues to advance, the toggle latch rotates about its fixed axis 865 and forces the rail 852 against the upper wall 862 of the slot 854. The upper wall 862 of the slot 854 is provided with teeth 864 that engage opposed teeth 866 on the upper surface 868 of rail 852. The engaged teeth 864, 866 prevent rail 852 from being withdrawn from slot 854, thereby maintaining modular connectors 800*a*, 800*b* in a joined configuration. Additional modular connectors (not shown) may be added to the assembly in a similar manner.

Best seen in FIG. 37, the conductive body 802 may be enclosed in an insulative outer housing 870 like that described above with respect to housings 170, 370 and 770, including an opening 880 having a sealing member 882 to provide a moisture seal around the cable conductor. Housing 870 may optionally be provided with latch means 886 for providing additional mechanical engagement between mating modular connectors 800*a*, 800*b*. In FIGS. 36 and 37, the back wall of the housing 870 has been removed to allow viewing the inside of the modular connector 800.

Figure 38:
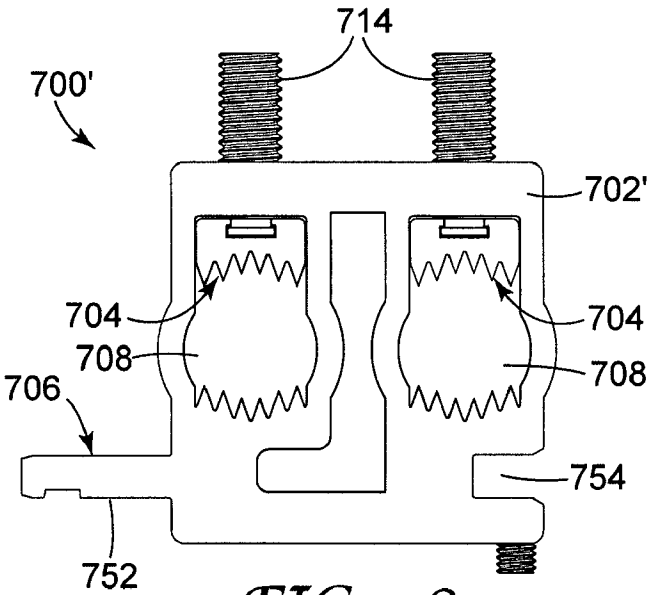
FIG. 38 is a front elevational view of another embodiment of a modular electrical connector according to the invention, illustrating a dual cable modular electrical connector, without an insulative housing.

The embodiments and methods described herein to create an inter-module connection between two or more connector modules are not intended to be limiting. Additional embodiments and methods for forming an inter-module connection are contemplated. For example, each of the modular connector embodiments illustrated and described herein may be adapted to accept two or more cable conductor ends. FIGS. 15 and 16 describe one specific embodiment in which a modular connector is configured to accept two cable conductor ends. In FIG. 38, another embodiment of a modular electrical connector configured to accept two cable conductor ends is illustrated. The dual modular electrical connector 700' of FIG. 38 is adapted and modified from the single cable embodiment of FIGS. 32–34, and like parts are similarly numbered. The dual modular electrical connector 700' includes a conductive body 702' having two cavities 708 that extend longitudinally through the body 702'. Each cavity 708 is provided with a clamping member 704 that is configured as described above with respect to FIGS. 32–34. The electrical bus 706 of module 700' is also configured as described above with respect to FIGS. 32–34, and includes a laterally extending rail 752, and a slot 754 in the body 702' for receiving a mating rail 752. The dual modular connector 700' may be connected with other similarly constructed dual modular connectors 700', or may be connected with the single cable modular connector 700 illustrated in FIGS. 32–34.

Figure 39:
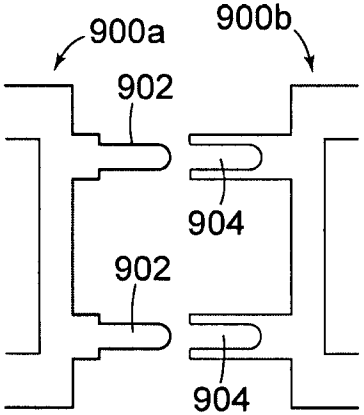
FIG. 39 is a partial front elevational view of another embodiment of a modular electrical connector having an electrical bus according to the invention, without an insulative housing.

In other embodiments, additional hermaphroditic and male/female electrical bus connector configurations may be used, or different numbers of inter-module connection points may be used. Other electrical bus connector configurations may be substituted for those illustrated. For example, a wedge-shaped electrical bus connector configuration is illustrated in FIG. 39, where a wedge-shaped projection 902 on a first connector module 900*a* is received by wedge-shaped slot 904 on a second connector module 900*b*. Additionally, various combinations of the above-illustrated and described embodiments may be combined and/or interchanged into a functional modular connector unit.

In use, each of the connector module embodiments described herein may be used to branch a cable by electrically connecting a first cable conductor to a first connector module, and electrically connecting a second cable conductor to a second connector module. The connector modules may be constructed according to any of the embodiments illustrated and describe herein, where each connector module includes a first electrical bus portion on a first side of the module and a second electrical bus portion on a second side of the module. The first and second connector modules are then electrically connected by engaging the first electrical bus portion of the first connector module with the second electrical bus portion of the second connector module, as illustrated and described above. Additional branches may be formed by, for example, electrically connecting a third cable conductor to a third connector module, and then engaging the first electrical bus portion of the second connector module with the second electrical bus portion of the third connector module.

The electrically conductive bodies of the electrical connector modules may be formed of any suitable metal, including aluminum, copper, and brass, and blend, combinations and alloys thereof. In some embodiments, the conductive bodies may be plated with suitable materials, including nickel, tin, zinc, tin-lead, and alloys thereof.

The insulative housings of the electrical connector modules may be formed of any suitable engineering plastic, including polycarbonates, polyesters, acrylics, nylons, polypropylenes, acrylonitrile butadiene styrene (ABS), and blends thereof.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electromechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical connector for use with a cable conductor, the connector comprising:

a conductive body having a cavity therein, the cavity configured to receive an end of a first cable;

a first clamping member for making electrical connection with the end of the first cable;

a first male electrical bus portion affixed on a first side of the body; and a second female electrical bus portion extending into a second side of the body, wherein the male bus portion comprises a lockable mechanism configured to lock with a female bus portion of a mating connector module.

2. The electrical connector of claim 1, wherein the first electrical bus portion and the second electrical bus portion are configured to make electrical connection with bus portions of a plurality of other electrical connector having first and second electrical bus portions.

3. The electrical connector of claim 1, wherein the first and second electrical bus portions are on opposite sides of the body.

4. The electrical connector of claim 1, wherein the first and second electrical bus portions comprise receptacles for receiving a conductive bus pin therein.

5. The electrical connector of claim 1, wherein the first and second electrical bus portions comprise hermaphroditic connector halves.

6. The electrical connector of claim 1, wherein the body, the first electrical bus portion, and the second electrical bus portion are a monolithic structure.

7. The electrical connector of claim 1, wherein the cavity extends into the body along a first axis, the first clamping member is moveable in the cavity along a second axis, and the first and second electrical bus portions are aligned along a third axis.

8. The electrical connector of claim 7, wherein the first, second and third axes are substantially orthogonal to each other.

9. The electrical connector of claim 1, further comprising a sealing member positioned at an entrance of the cavity and configured to form a moisture seal around the cable.

10. The electrical connector of claim 9, further comprising an insulative housing surrounding the conductive body, the insulative housing including an opening for receiving a cable conductor and allowing access to the cavity, wherein the sealing member covers the opening in the insulative housing.

11. The electrical connector of claim 9, wherein the sealing member is a resilient material.

12. The electrical connector of claim 11, wherein the resilient material is selected from the group consisting of chemically cross-linked elastomers, physically cross-linked elastomers, and combinations and blends thereof.

13. The electrical connector of claim 12, wherein the resilient material is a terpolymer of ethylene-propylene-diene monomer.

14. The electrical connector of claim 1, further comprising a plurality of projections on the first clamping member.

15. The electrical connector of claim 14, wherein the projections on the first clamping member are configured to pierce insulation on the cable and make electrical connection with the cable conductor as the first clamping member clamps the end of the first cable.

16. The electrical connector of claim 1, further comprising an insulative housing surrounding the conductive body.

17. The electrical connector of claim 1, wherein the cavity is configured to receive an end of a second cable, the connector further comprising a second clamping member for making electrical connection with the end of the second cable.

18. The electrical connector of claim 17, wherein the cavity includes a dividing wall forming separate cavities for receiving ends of the first cable and the second cable.

19. The electrical connector of claim 1, wherein at least one of the first bus portion and the second bus portion includes a latching mechanism for maintaining physical engagement between the first and second bus portions.

20. The electrical connector of claim 19, wherein the latching mechanism comprises a set screw.

21. The electrical connector of claim 19, wherein the latching mechanism comprises a toggle latch.

22. The electrical connector of claim 19, wherein the latching mechanism comprises a resiliently deflectable arm and a mating receptacle on the first and second bus portions, respectively.

23. The electrical connector of claim 1, wherein the first clamping member clamps the end of the first cable against an interior wall of the cavity.

24. The electrical connector of claim 23, wherein at least one of the first clamping member and the interior wall of the cavity includes a plurality of projections configured to pierce insulation on the cable and make electrical connection with the cable conductor as the first clamping member clamps the end of the first cable against the interior wall of the cavity.

25. The electrical connector of claim 1, further comprising:

a plurality of first electrical bus portions on the first side of the body; and a plurality of second electrical bus portions on the second side of the body.

26. The electrical connector of claim 1, wherein the cavity is configured to receive an end of a first cable ranging in size from #14 AWG to 1000 kcmil.

27. An electrical connector system comprising:

a first connector module configured for electrical connection to a first cable conductor; and a second connector module configured for electrical connection to a second cable conductor;

wherein each of the first and second connector modules includes a first conductive male engagement member on a first side of the module which comprises a lockable mechanism and a second conductive female engagement member on a second side of the module;

wherein the first conductive male engagement member of the first connector module is configured for lockable engagement with the second conductive female engagement member of the second connector module.

28. The electrical connector system of claim 27, wherein the first and second connector modules are identically shaped.

29. The electrical connector system of claim 27, wherein the first and second connector modules are configured to receive differently sized cable conductors.

30. The electrical connector system of claim 27, wherein at least one of the first and second conductive engagement members of each module comprise longitudinally extending arms.

31. The electrical connector system of claim 30, wherein the longitudinally extending arms are resiliently deflected when the first engagement member of the first connector module engages the second engagement member of the second connector module.

32. The electrical connector system of claim 27, wherein each connector module further comprises a conductive body surrounded by an insulative housing.

33. The electrical connector system of claim 27, wherein each of the connector modules includes a clamping mechanism for clamping the respective cable conductor within the module.

34. The electrical connector system of claim 33, wherein the clamping mechanism comprises an insulation piercing connector.

35. A modular electrical connector for use with a cable conductor, the connector comprising:

a conductive body having a plurality of clamping members, each of the plurality of clamping members configured for making electrical connection with a corresponding cable conductor;

a first male electrical bus portion affixed on a first side of the conductive body comprising a lockable mechanism; and a second female electrical bus portion extending into a second side of the conductive body, wherein the male bus portion is configured to lock with a female bus portion of a mating connector module.

36. The modular electrical connector of claim 35, wherein each of the plurality of clamping members are positioned within a corresponding one of a plurality of cavities in the body.

37. The modular electrical connector of claim 35, wherein each of the plurality of clamping members are positioned within a single cavity in the body.

38. The modular electrical connector of claim 35, wherein the first electrical bus portion and the second electrical bus portion are configured to make electrical connection with second and first electrical bus portions, respectively, of a similar modular electrical connector.

39. The modular electrical connector of claim 35, wherein the male connector portion is a pin.

40. The modular electrical connector of claim 39, wherein the pin includes resiliently deflectable latching arms.

41. The modular electrical connector of claim 35, wherein the male connector portion is a rail.

42. The modular electrical connector of claim 41, wherein the female connector portion is a slot shaped to receive a mating rail of an identical modular electrical connector.

43. The modular electrical connector of claim 42, wherein the slot includes a locking mechanism configured to advance into the slot and engage the mating rail.

44. The modular electrical connector of claim 43, wherein the male bus portion and the female bus portion lock with a set screw.

45. The modular electrical connector of claim 41, wherein the rail has a wedge-shaped cross-sectional profile.

46. A modular electrical connector for use with a cable conductor, the connector comprising:

a conductive body having at least one clamping member configured to make electrical connection with a cable conductor;

means on the body for electrically and mechanically connecting the body to another modular electrical connector having similar connector means.

47. The modular electrical connector of claim 46, wherein the connector means comprises:

a male connector half on a first side of the body; and a female connector half on a second side of the body.

48. The modular electrical connector of claim 47, wherein the male connector half comprises a rail extending from the body, and wherein the female connector half comprises a slot extending into the body.

49. The modular electrical connector of claim 47, wherein the male connector half comprises at least one resiliently deflectable arm extending from the body, and wherein the female connector half comprises an arm receiving receptacle on the body.

50. The modular electrical connector of claim 46, wherein the connector means comprises hermaphroditic connectors extending from the body.

51. The modular electrical connector of claim 46, wherein the connector means includes a mechanism for locking the modular electrical connector to another modular electrical connector.

52. The modular electrical connector of claim 51, wherein the mechanism for locking the modular electrical connector to another modular electrical connector comprises a set screw.

* * * * *

UNITED STATES PATENT AND TRADEMARK OFFICE

CERTIFICATE OF CORRECTION

PATENT NO. : 7,104,832 B2 
APPLICATION NO. : 10/911858
DATED : September 12, 2006
INVENTOR(S) : James M. Campbell It is certified that error appears in the above-identified patent and that said Letters Patent is hereby corrected as shown below:

Column 1,
Line 8, after "10/911,802" insert -- , --.
Line 9, insert -- having Attorney Docket No. 60056US002, -- before "filed".

Column 5,
Line 6, delete "elevational" and insert -- elevational --, therefor.

Column 8,
Lines 54—56, delete "The modular electrical……...of the connector."
and insert the same on the line 53 as a new paragraph.

Column 17,
Lines 44—45, delete "electromechanical," and insert -- electro-mechanical, --, therefor.

Signed and Sealed this

Twenty-eighth Day of November, 2006

JON W. DUDAS
*Director of the United States Patent and Trademark Office*